US005175972A

United States Patent [19]

Sridhara

[11] Patent Number: 5,175,972

[45] Date of Patent: Jan. 5, 1993

[54] SLEEVED COMPRESSION MEMBER

[75] Inventor: Benne N. Sridhara, Bangalore, India

[73] Assignees: Hasnain Investments (P) Limited, Maharashtra; Tube Investments of India Limited, Tamil Nadu, both of India; a part interest to each

[21] Appl. No.: 626,758

[22] Filed: Jul. 2, 1984

[51] Int. Cl.[5] ..... E04C 3/30

[52] U.S. Cl. ..... 52/727; 52/728

[58] Field of Search ..... 52/632, 636, 655, 226, 52/725, 727, 116, 720, 722, 728, 294, 296, 263, 224; 248/354.1, 354.3, 354.4, 35.5

[56] References Cited

U.S. PATENT DOCUMENTS

| | | | |
|---|---|---|---|
| 157,908 | 12/1874 | Cornell . | |
| 173,963 | 2/1876 | Johnson et al. . | |
| 256,478 | 4/1882 | Harrison . | |
| 701,377 | 5/1902 | Norcross . | |
| 846,450 | 3/1907 | Brown . | |
| 997,435 | 7/1911 | Bowman . | |
| 1,244,119 | 10/1917 | Mulnix et al. | 52/728 |
| 1,280,426 | 10/1918 | Dumas | 52/722 X |
| 1,302,293 | 4/1919 | Boazer . | |
| 1,409,422 | 3/1922 | Squire et al. | 52/728 X |
| 2,160,454 | 5/1939 | Bucky | 298/354.3 |
| 2,453,079 | 11/1948 | Rossmann | 52/727 X |
| 2,470,149 | 5/1949 | Derby | 52/725 X |
| 3,232,638 | 2/1966 | Hollander | 175/320 |

FOREIGN PATENT DOCUMENTS

| | | | |
|---|---|---|---|
| 2449 | 10/1961 | United Kingdom | 52/727 |

*Primary Examiner*—David A. Scherbel
*Assistant Examiner*—Creighton Smith
*Attorney, Agent, or Firm*—Pennie & Edmonds

[57] ABSTRACT

A sleeved compression member having at least one core piece which is subjected to a compression load. The core is surrounded by a sleeve which is spaced from the sides of each core piece and is adapted to be engaged by a core piece when the core piece is subjected to a compression load such that the sleeve is subjected to bending loads only.

17 Claims, 19 Drawing Sheets

L
L/4
L/4
L/4
L/4
δ0
δ1
δ2
F1
F2
F1
P
P
2F1+F2
2
θ
θ
R
(δ0+δ1)
(δ0+δ2)

L/5
L
δ0
P
(F1+F2)
F1
F2
δ1
δ2
θ
α
R
(δ0+δ1)
(δ0+δ2)

SLEEVED COMPRESSION MEMBER

FIELD OF THE INVENTION

This invention relates to a sleeved compression member and more particularly to a compression member having an improved resistance to buckling on application of compression loads to axial ends of the member.

BACKGROUND OF THE INVENTION

Compression members adapted to take compression loads are used in a variety of structures. For example such members may be used in building columns to support roof structure, may be used as booms in cranes, may be used as legs to support off-shore drilling platforms and may be used as part of an adjustable prop to name just a few uses. It is known that the slenderness ratio of such members can have an effect on the ability of the member to withstand compression loads without buckling and equations have been developed to determine the maximum column compression load that a column may be subjected to without buckling. For example the critical column load for pin ended columns as determined by Euler's equation is $$Pcr = \frac{\pi^2 EI}{l^2}$$

where E is the modulus of elasticity of the material comprising the column, ( the length of the column and I the least moment of inertia of cross-section of the column.

Thus the factors determining the critical compressive load to which a column or member of a set length may be subjected without buckling is determined by the modulus of elasticity of the material making up the column and/or the cross-sectional area of the column. This results in heavy columns often made of expensive materials and, in the case of long columns or structural members, in extremely heavy structural members, which due to their length, may be difficult to transport and install.

It is therefore an object of my invention to provide for an improved compression member having an improved resistance to buckling and, which for a given length and given load, may be lighter and less expensive than conventional compression members.

It is a further object of my invention to provide for a compression member which may be broken down into separate parts for ease of transport and installation.

GENERAL DESCRIPTION OF THE INVENTION

Broadly a compression member constructed according to my invention comprises a core which is adapted to be subjected to a compression load applied to axial ends of the core. The core is surrounded by a sleeve which is spaced from the core and which is adapted to be subjected to bending forces only when the core bends under the force of the compression load to contact the inner sides of the sleeve. As a result of this construction, compression forces act only on the core and any bending moment produced by the stresses act on the sleeve, but not on the core, thus isolating the bending moment and the compressive forces.

In order to further assure that the sleeve will not be subjected to any portion of the compression load, the sleeve is made shorter than the core so that the ends of the sleeve will not contact structure subjected to compression loads.

The core itself may comprise a plurality of discrete pieces placed end-to-end and in contact with each other. This allows the core to be transported in disassembled form resulting in ease of shipping and handling. The separate core pieces need not be joined by any structure which facilitates assembly and since the core pieces only have to withstand compression loads, they may comprise inexpensive material.

The sleeve can also be broken down into separate pieces and joined by single light joints since the joints do not take compression loads further aiding in ease of assembly. Further the sleeve itself is comparatively light when compared to the total weight of all the core pieces further aiding in assembly.

The space between the core and sleeve may be filled with a corrosion inhibiting fluid, for example, oil, to reduce corrosion of the member and if the member is subjected to vibration, shock absorbers can be installed between the core and sleeve. Even if the sleeve vibrates, it still can provide effective lateral restraint to the core to provide necessary resistance to bending.

The use of a separate spaced sleeve surrounding the core as provided by my invention also is applicable for the repair or strengthening of conventional single piece compression members. Thus if a single piece conventional compression member breaks or cracks, or even becomes weakened due to corrosion or other factors, it may be easily repaired or strengthened by installing a spaced sleeve around the broken or weakened sections. In such an instance the sleeve will not carry any of the original compression load, but only carry any bending loads caused by the core deflecting and contacting the interior of the sleeve.

The compression member as constructed provides a further important feature. It is possible to stress the core temporarily beyond its yield point while at the same time keeping stress within the sleeve within permissible limits. Such a situation will not cause failure as in conventional compression members where temporary loading beyond the yield stress will result in buckling failure.

The ability of the sleeve to resist bending forces depends in part on the stiffness of the sleeve which can be further enhanced by joining parallel sleeves with frame pieces to form a latticework of sleeves each surrounding and being spaced from a core. In this instance the total stiffness of the latticework further adds to the stiffness of each sleeve to restrain buckling of the core which it surrounds.

Sleeved compression members constructed either as single members as described above or in latticework arrangment are applicable for use in a number of applications.

In particular the sleeved compression members either alone or in latticework may be used as booms for cranes, building supports for industrial structures, in pile extraction devices or adjustable props, supporting columns for gallow derricks, legs for off-shore platforms or as scaffolding structure.

for various values of $$\frac{I_s}{I}$$

Figure 1A:
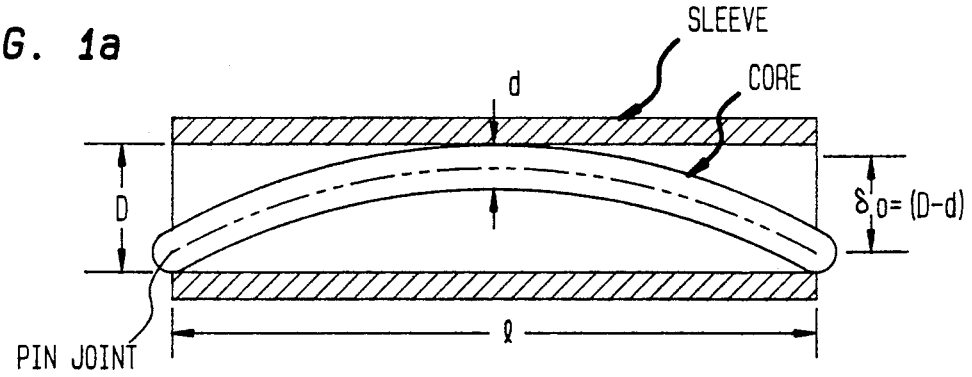
FIG. 1*a* is a schematic sketch of a compression member according to the invention having a single continuous core under no load conditions.

for the compression member of FIG. 1*a;*

Figure 4:
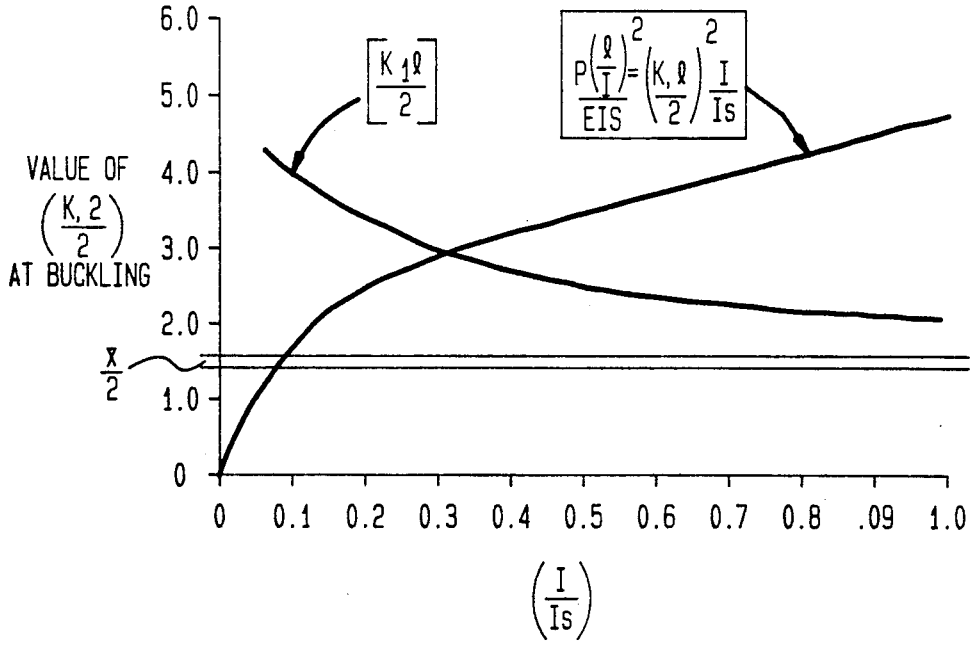

FIG. 4 is a graph illustrating variation of $$\frac{K_1 l}{2} \text{ with } \frac{I}{I_s}$$

for the compression member of FIG. 1*a;*

Figure 5:
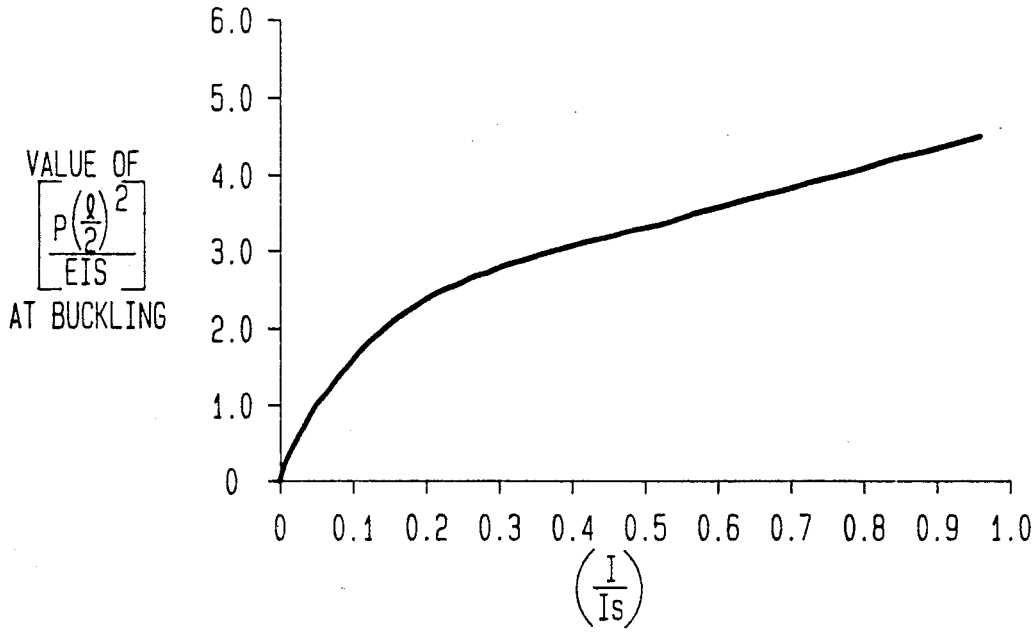

FIG. 5 is a graph illustrating experimental results of loading a member as shown in FIG. 1*a* as compared with theoretical results of variations of $$\frac{P\left(\frac{(l)}{2}\right)^2}{EI_s} \text{ vs. } \frac{I}{I_s};$$

Figure 6A:
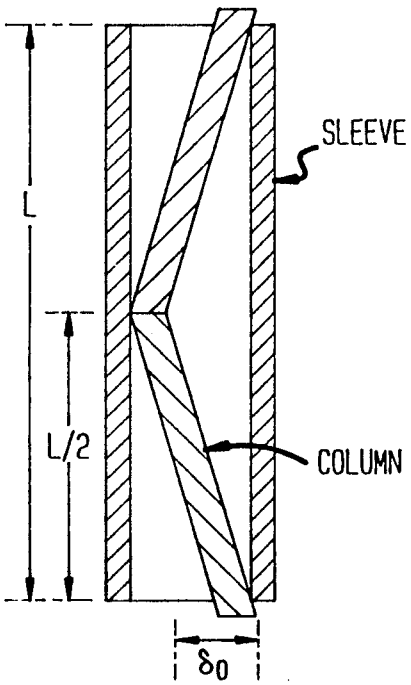
Figure 6B:
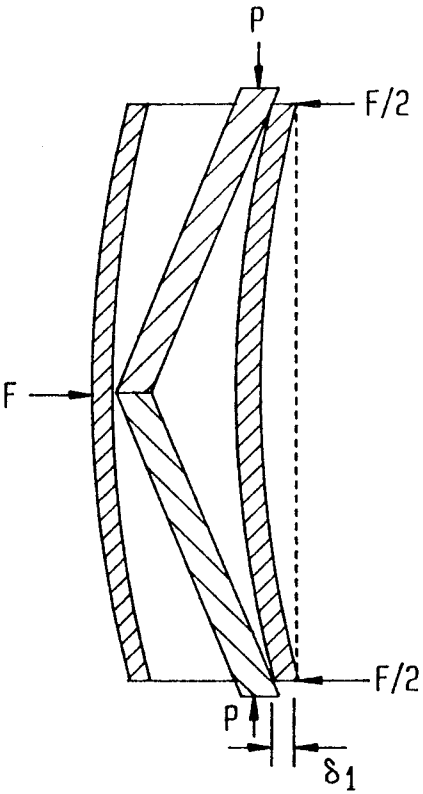
Figure 6C:
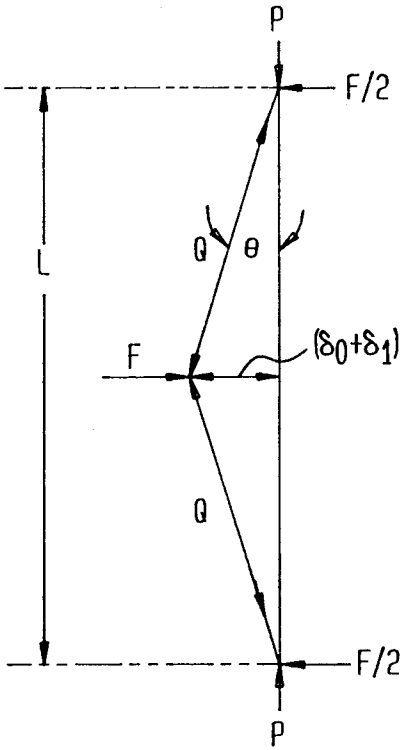
Figure 6D:
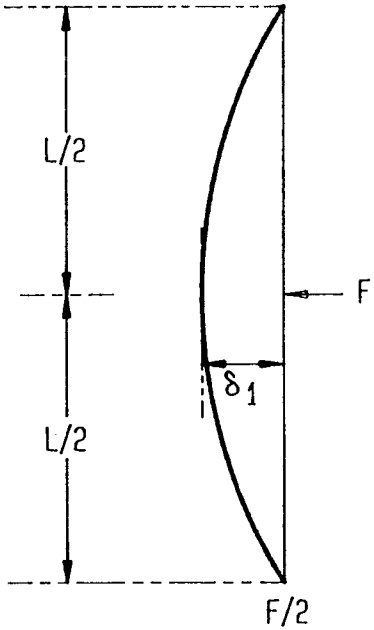

FIG. 6*a* is a schematic sketch of a sleeved compression member according to the invention having a core made up of two equal parts under no load conditions;

FIG. 6*b* is a sketch of the compression member of FIG. 6*a* subjected to a load;

FIG. 6*c* is a diagram of the geometry of deflected core pieces of the member of FIG. 6*a* under load conditions and forces exerted on them;

FIG. 6*d* is a load diagram of forces acting on the sleeve and deflection of the sleeve of the member shown in FIG. 6*a;*

Figure 7A:
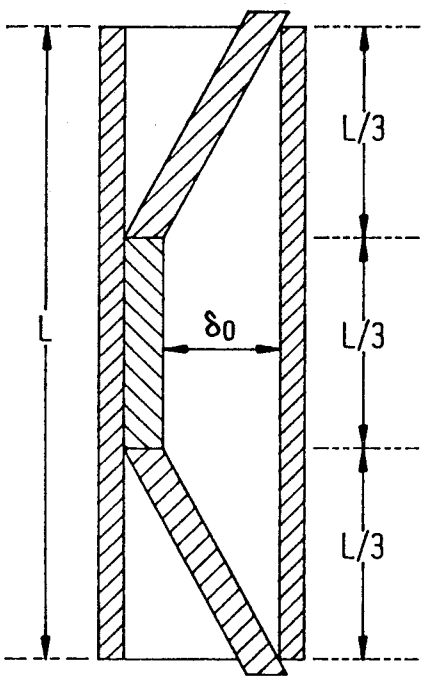
Figure 7B:
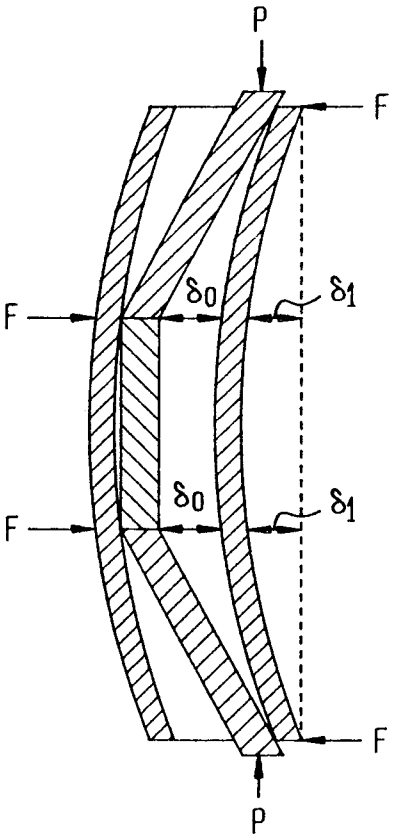
Figure 7C:
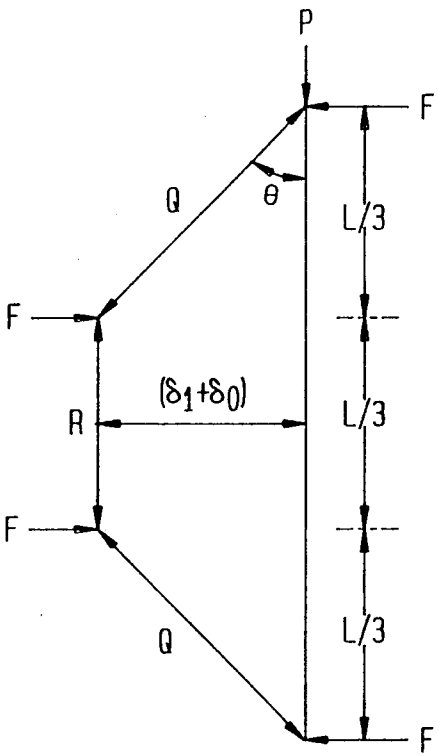
Figure 7D:
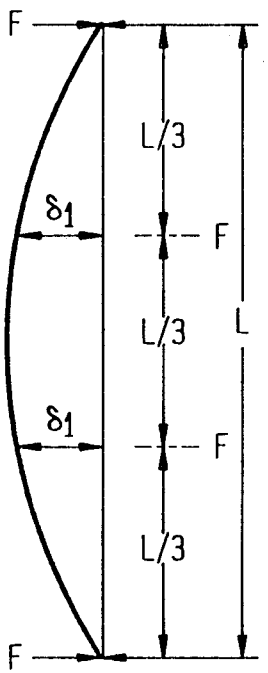

FIG. 7*a* is a sketch of a sleeved compression member according to the invention having a core made up of three equal parts;

FIG. 7*b* is a sketch of the compression member of FIG. 7*a* subjected to a load;

FIG. 7*c* is a diagram of the geometry of deflected core pieces of the member of FIG. 7*a* under load and forces exerted on them;

FIG. 7*d* is a load diagram of forces acting on the sleeve and the deflection of the sleeve of the member shown in FIG. 7*a;*

Figures 8A, 8B, 8C, 8D:
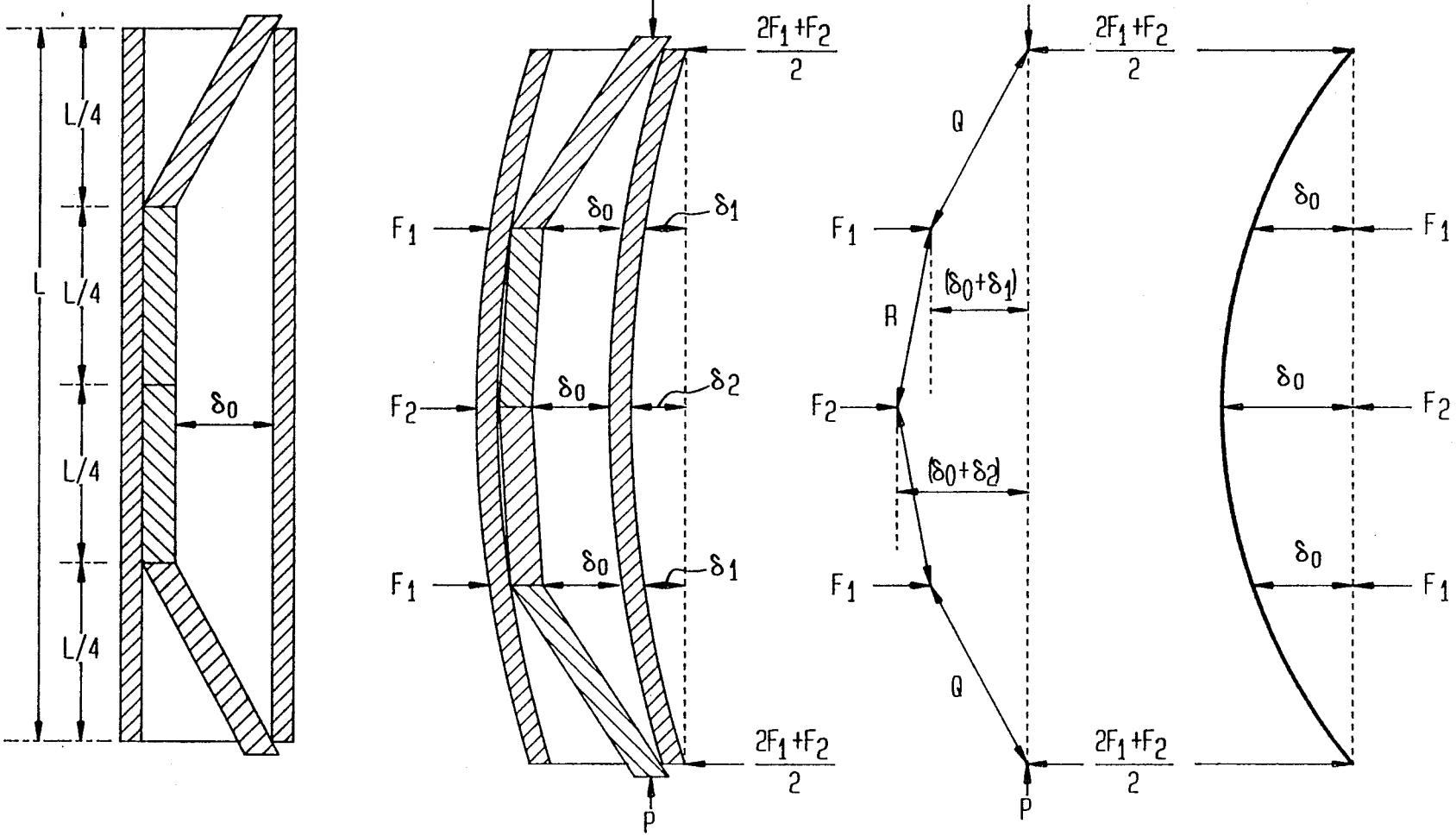

FIG. 8*a* is a sketch of a sleeved compression member according to the invention having a core made up of four equal parts under no load conditions;

FIG. 8*b* is a sketch of the member of FIG. 8*a* subjected to load conditions;

FIG. 8*c* is a diagram of the geometry of deflected core pieces of the member of FIG. 8*a* under load and the forces exerted on them;

FIG. 8*d* is a load diagram of forces acting on the sleeve and deflection of the sleeve of the member shown in FIG. 8*a;*

Figure 8H:
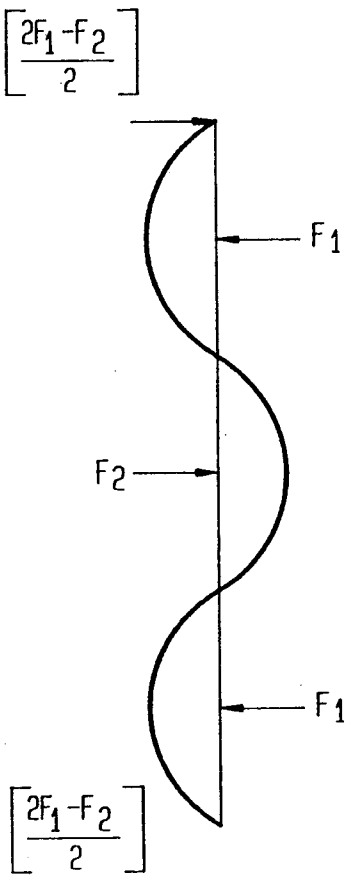
Figure 8G:
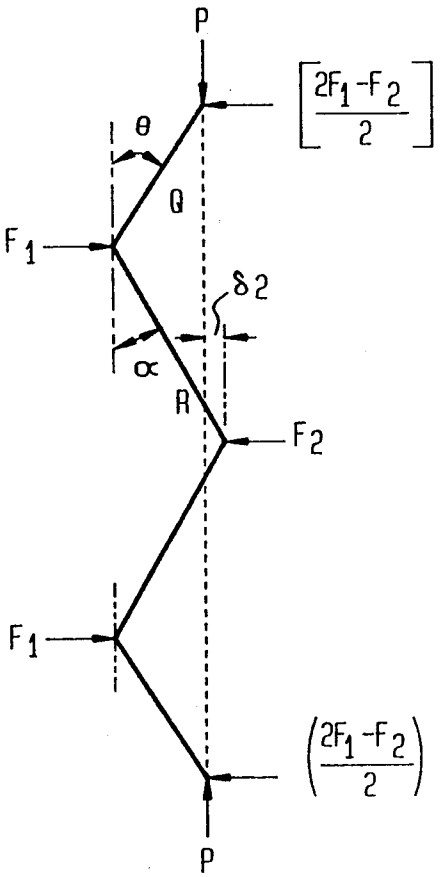
Figure 8F:
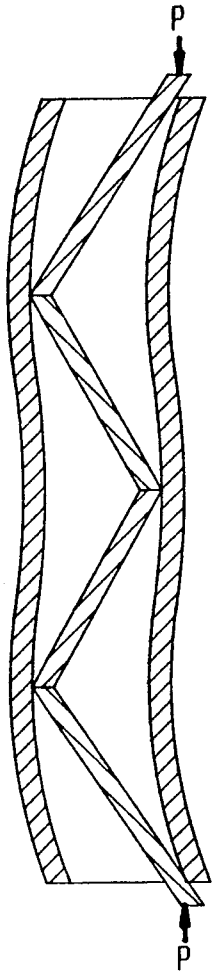
Figure 8E:
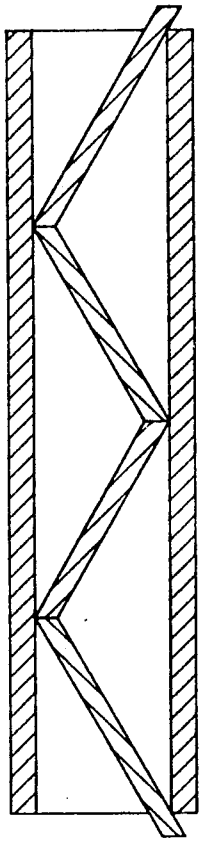

FIG. 8*e* is a sketch of a sleeved compression member according to the invention having a core made up of four equal parts arranged differently from that of the member of FIG. 8*a* and under no load;

FIG. 8*f* is a sketch of the member of FIG. 8*e* subjected to a load;

FIG. 8*g* is a diagram of the geometry of deflected core pieces of the member of FIG. 8*e* under load;

FIG. 8*h* is a load diagram of forces acting on the sleeve and deflection of the sleeve of the member shown in FIG. 8*e;*

Figures 9A, 9B, 9C, 9D:
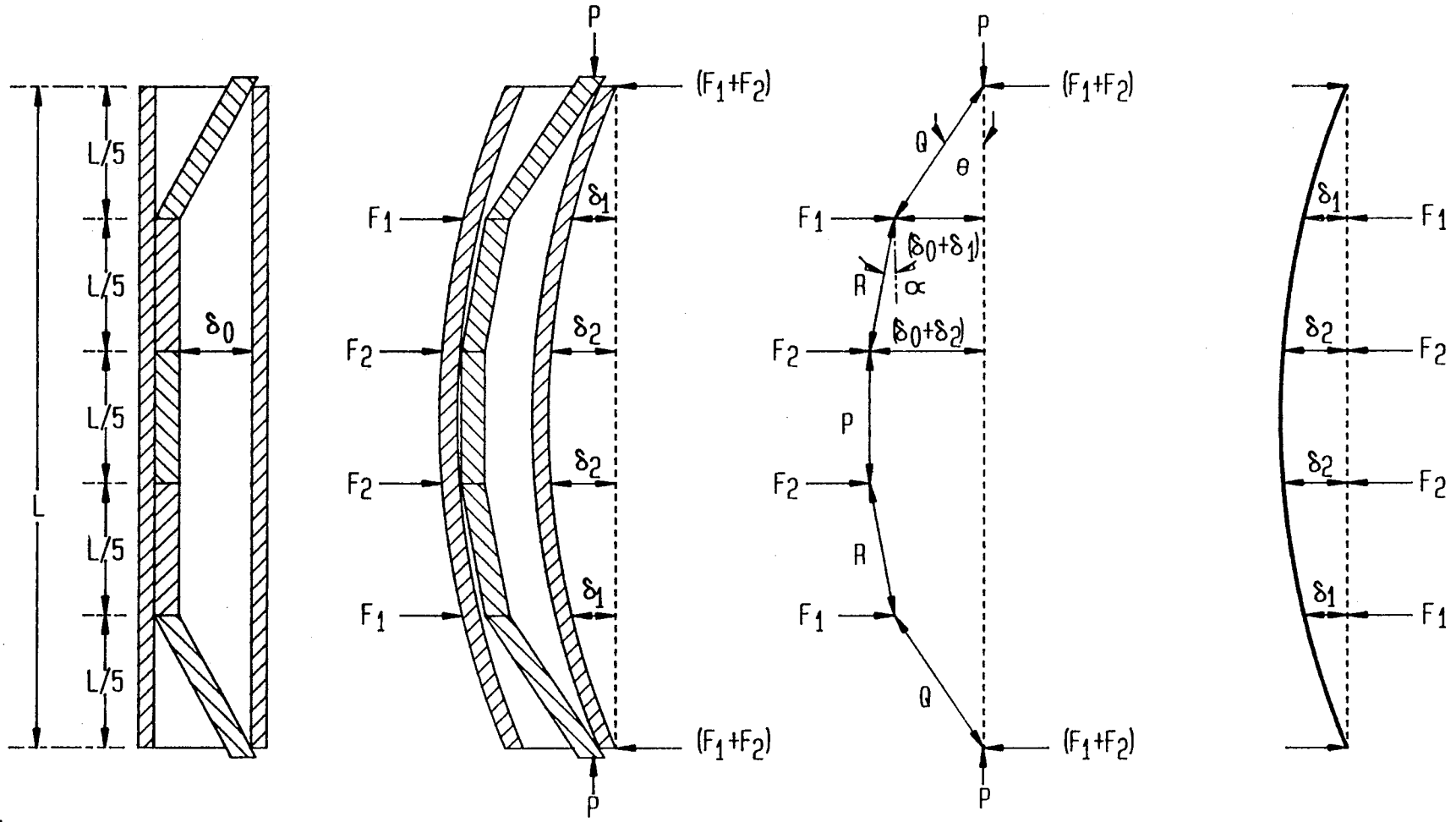
Figure 9G:
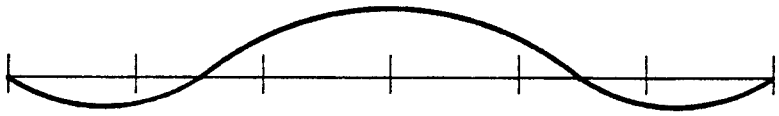

FIG. 9*a* is a sketch of a sleeved compression member having a core made up of five equal parts under load conditions;

FIG. 9*b* is a sketch of the member of FIG. 9*a* subjected to load;

FIG. 9*c* is a diagram of the geometry of the deflected core pieces of the member of FIG. 9*a* under load and the forces exerted on them;

FIG. 9*d* is a load diagram of forces acting on the sleeve and deflection of the sleeve of the member shown in FIG. 9*a;*

Figure 9F:
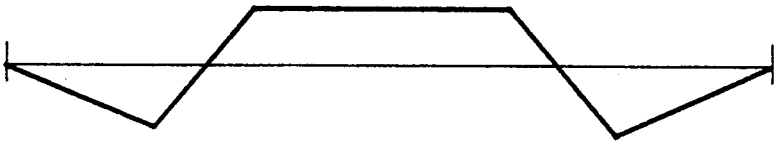
Figure 9E:
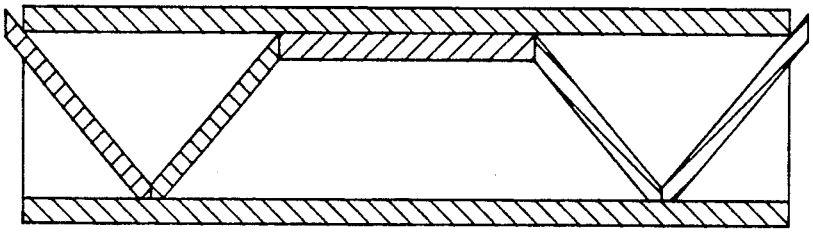

FIG. 9*e* is a sketch of a sleeved compression member having five equal parts arranged differently from that of the member of FIG. 9*a* and illustrating the geometry of the deflected core pieces and the forces exerted on them under load;

FIG. 9*f* is a load diagram of forces acting on the sleeve and deflection of the sleeve of the member having the core pieces arranged as in FIG. 9*e;*

Figure 10E:
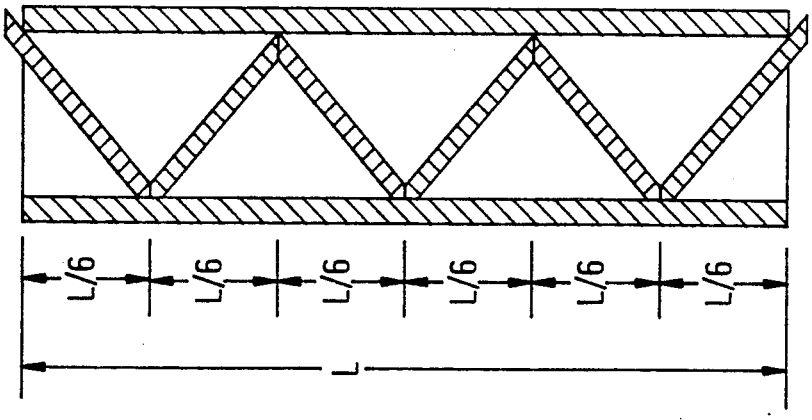
Figure 10A:
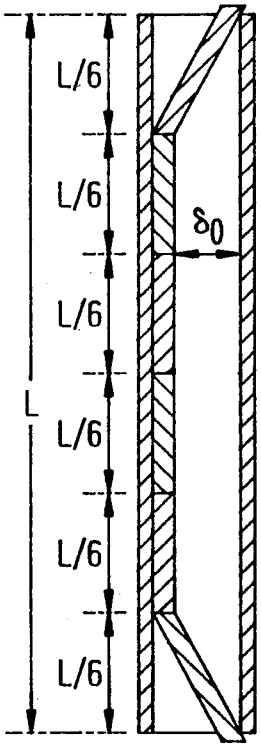
Figure 10B:
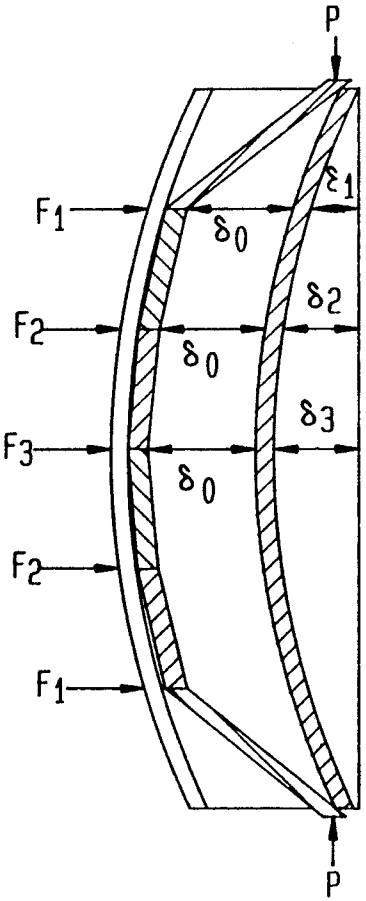
Figure 10C:
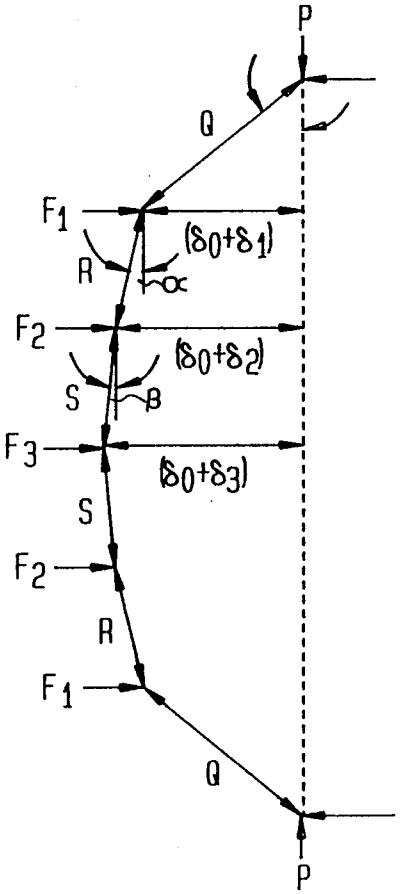
Figure 10D:
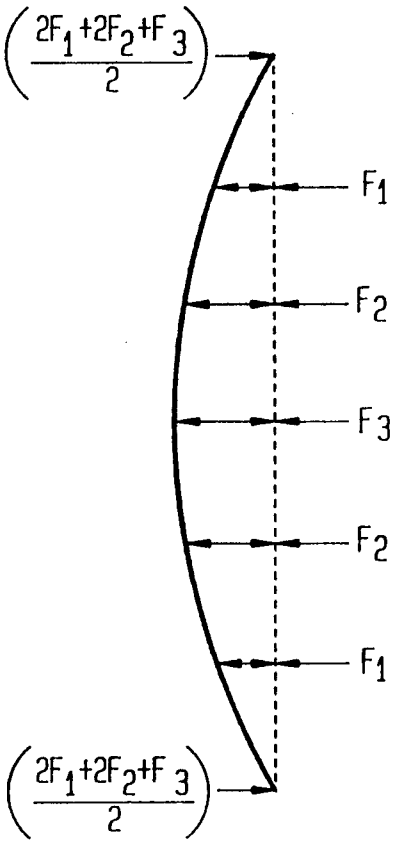

FIG. 10*a* is a sketch of a sleeved compression member having a core made up of six equal parts under no load conditions;

FIG. 10*b* is a sketch of the member of FIG. 10*a* a subjected to load;

FIG. 10*c* is a diagram of the geometry of the deflected core pieces of the member of FIG. 10*a* and the forces exerted on them;

FIG. 10*d* is a load diagram of forces acting on the sleeve and deflection of the sleeve of the member shown in FIG. 10*a;*

FIG. 10*e* is a sketch of a sleeved compression member having six equal parts arranged differently from that shown in FIG. 10*a;*

Figure 11:
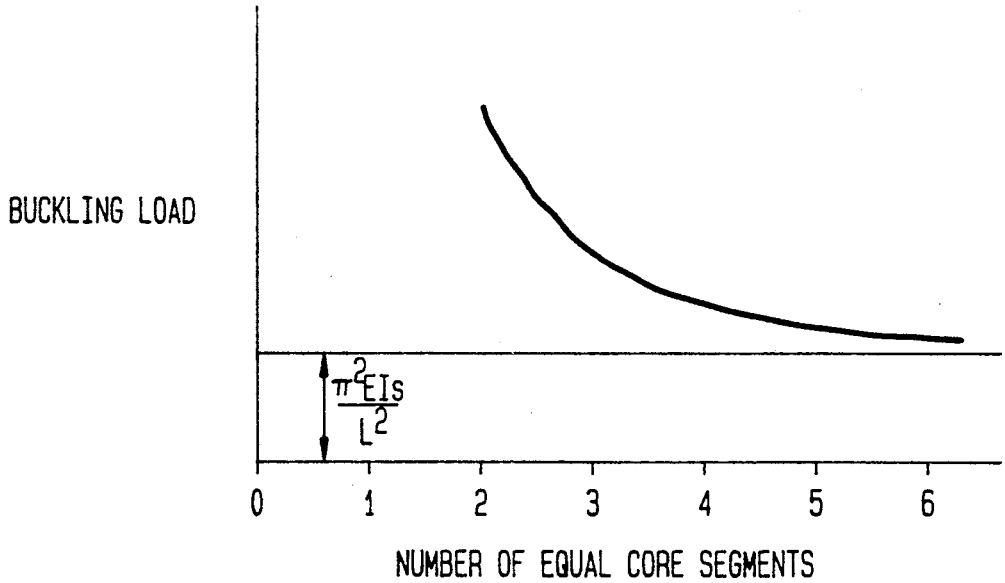
Figure 12A:
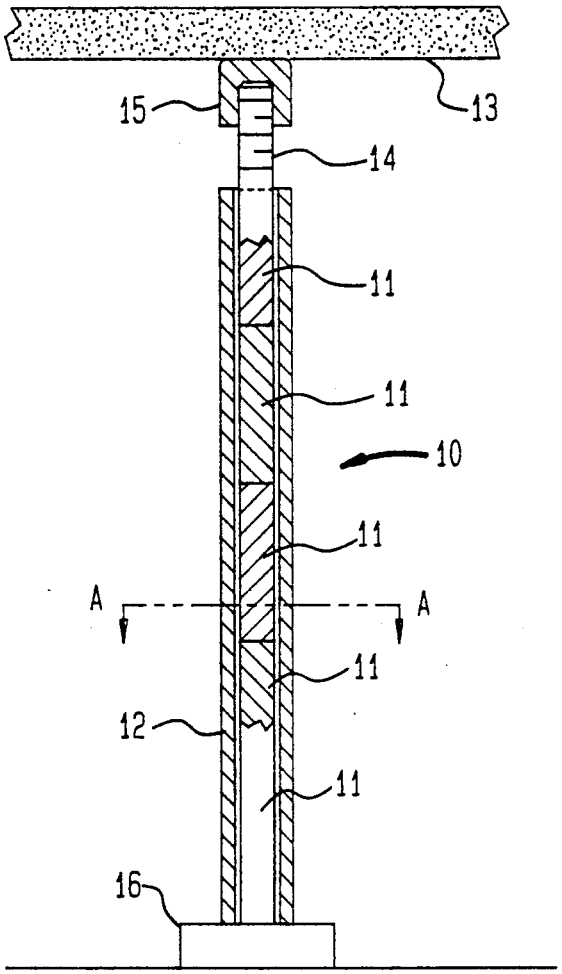
Figure 12B:
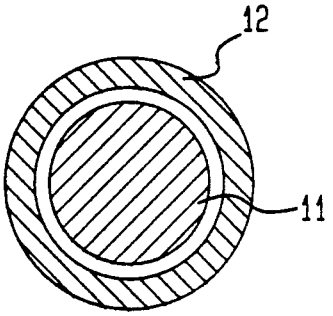
Figure 12C:
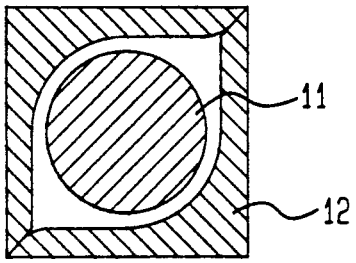
Figure 13A:
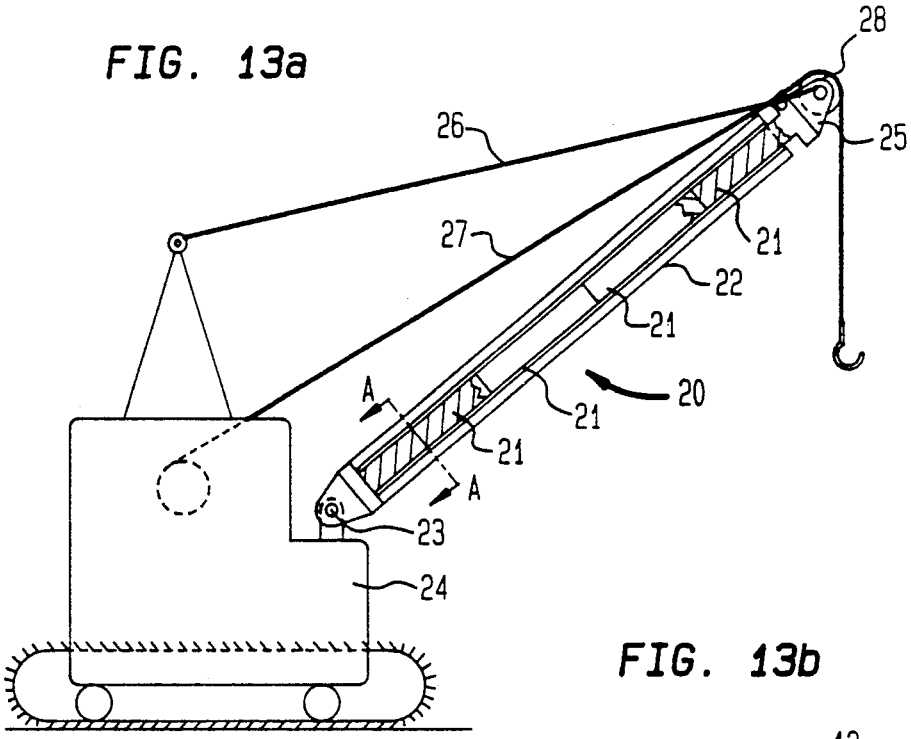
Figure 13B:
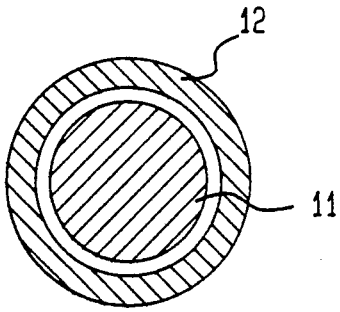
Figure 13C:
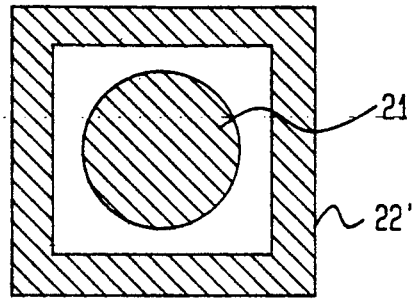
Figure 13D:
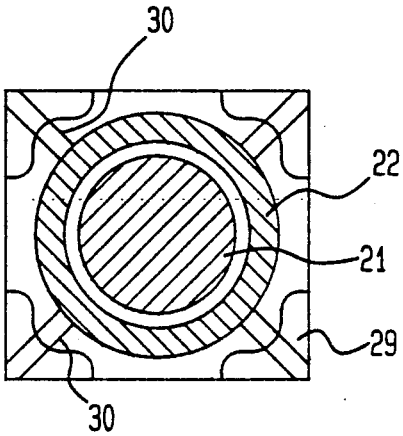
Figure 14A:
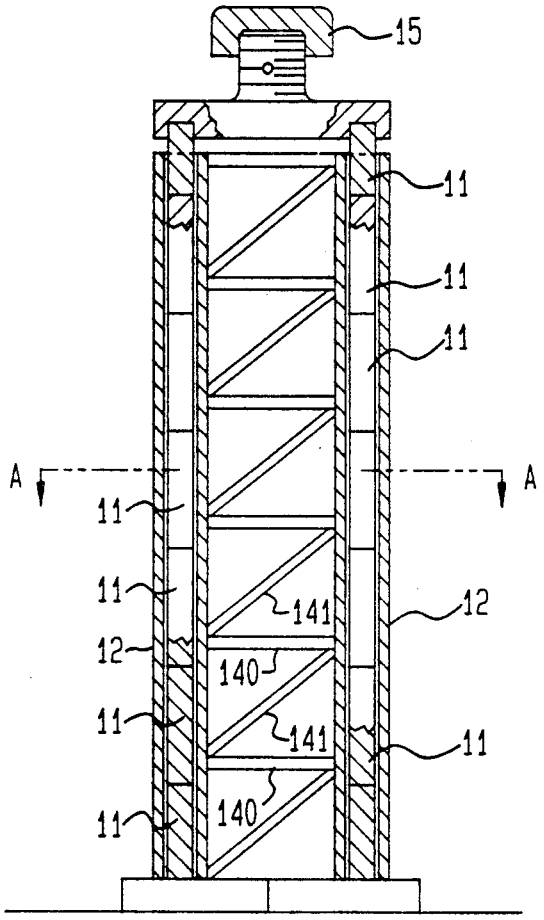
Figure 14B:
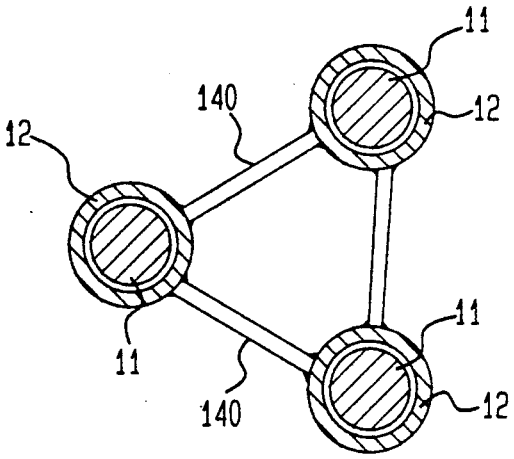
Figure 14C:
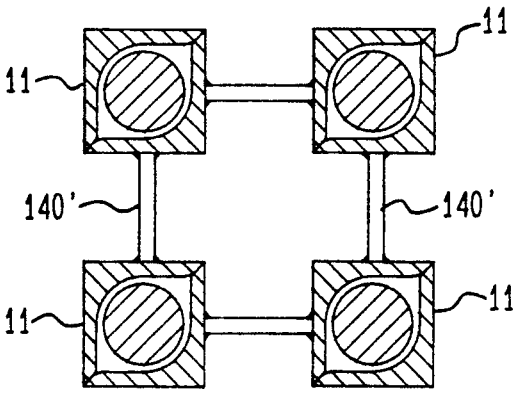
Figure 15B:
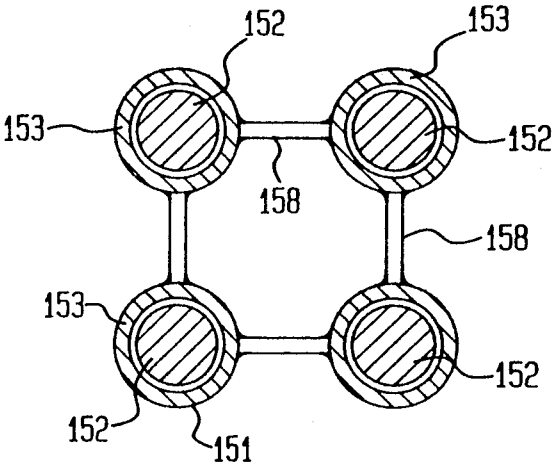
Figure 15C:
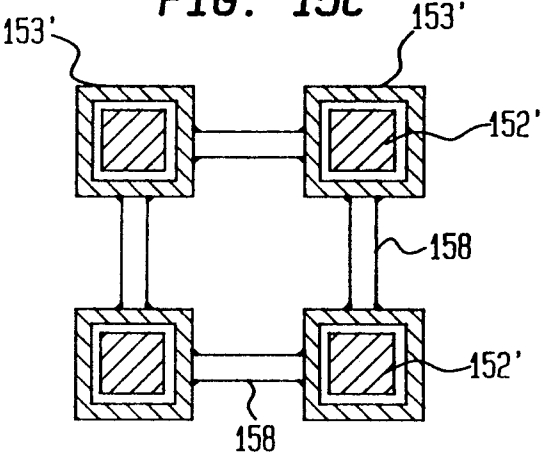
Figure 15A:
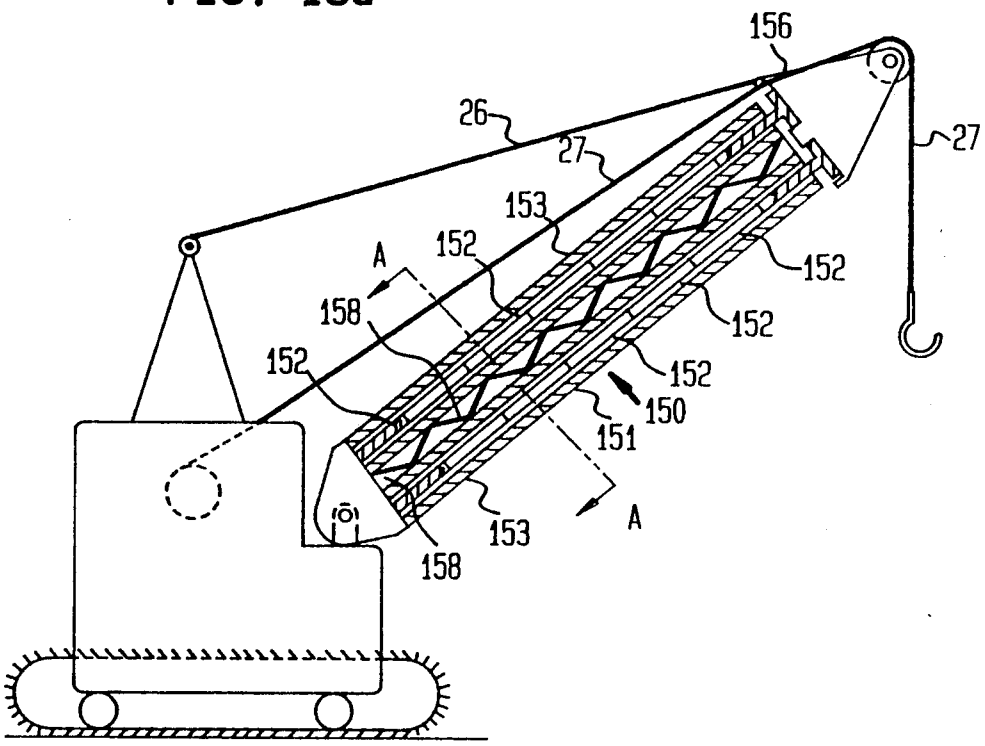
Figure 16A:
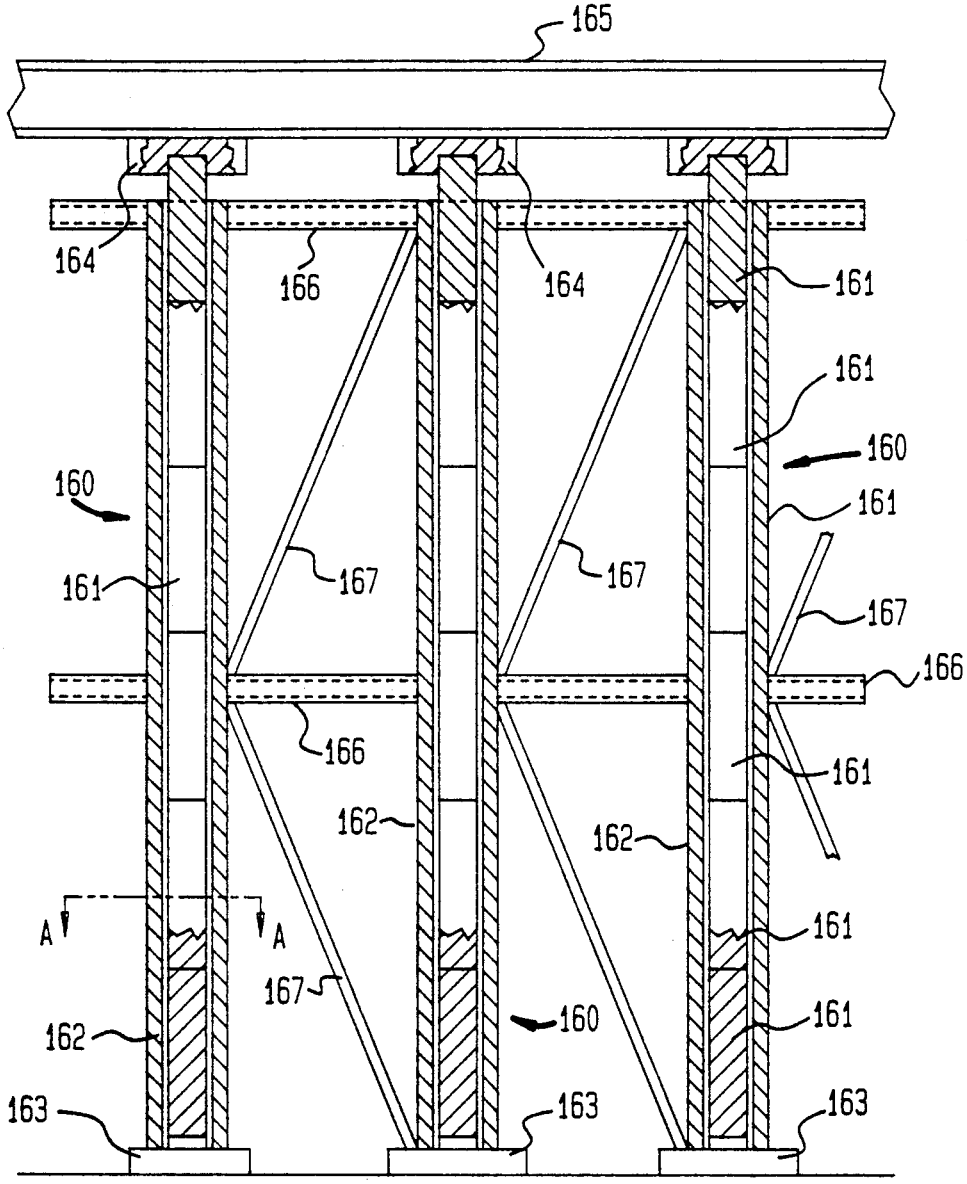
Figure 16B:
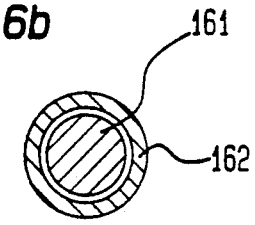
Figure 17:
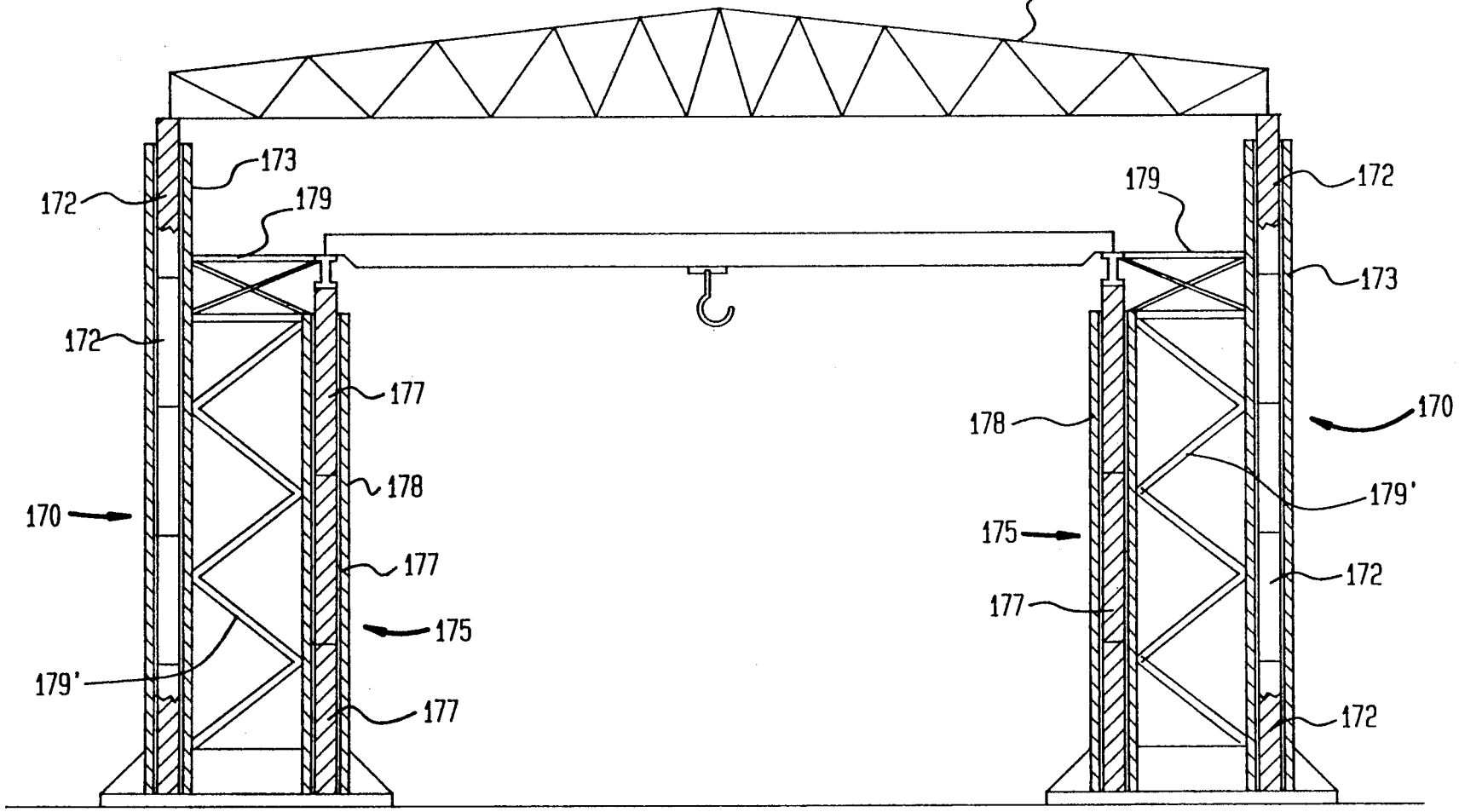
Figure 18A:
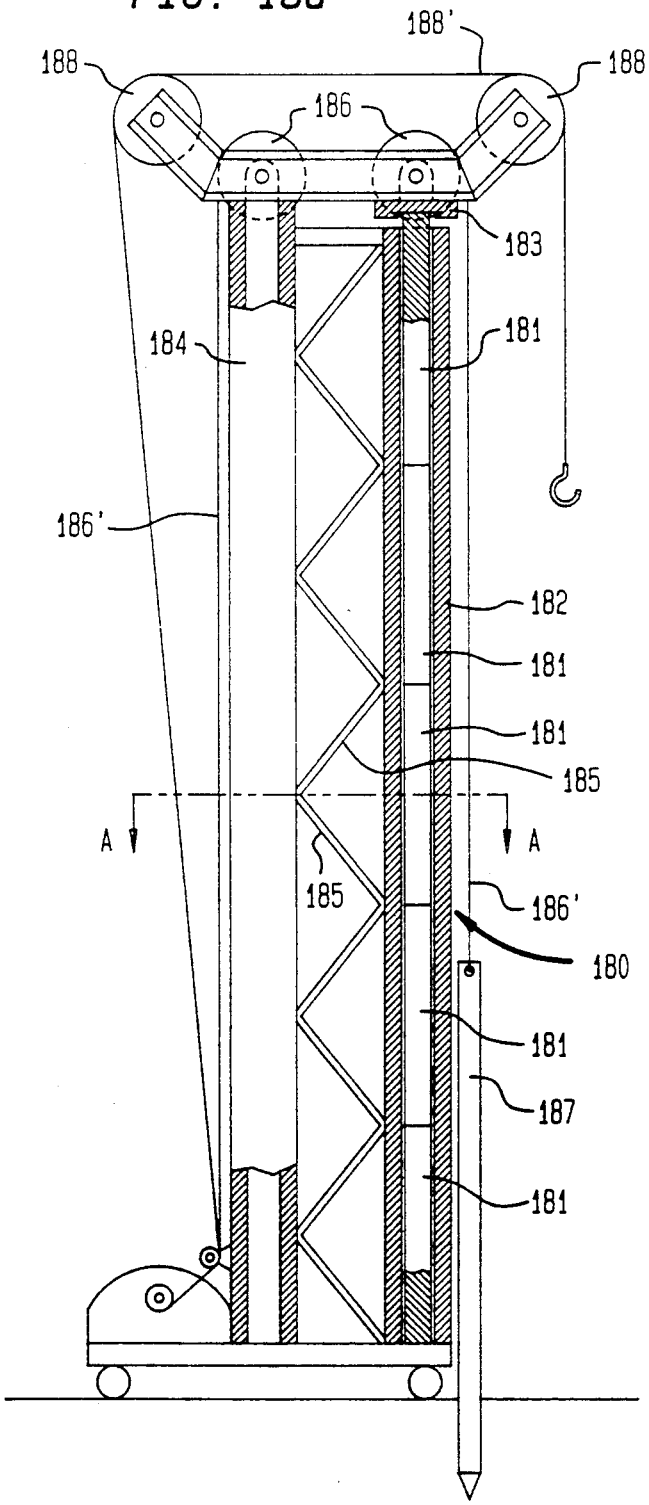
Figure 18B:
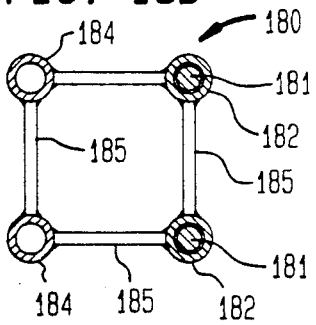
Figure 18C:
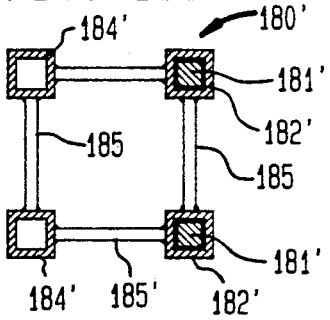
Figure 19A:
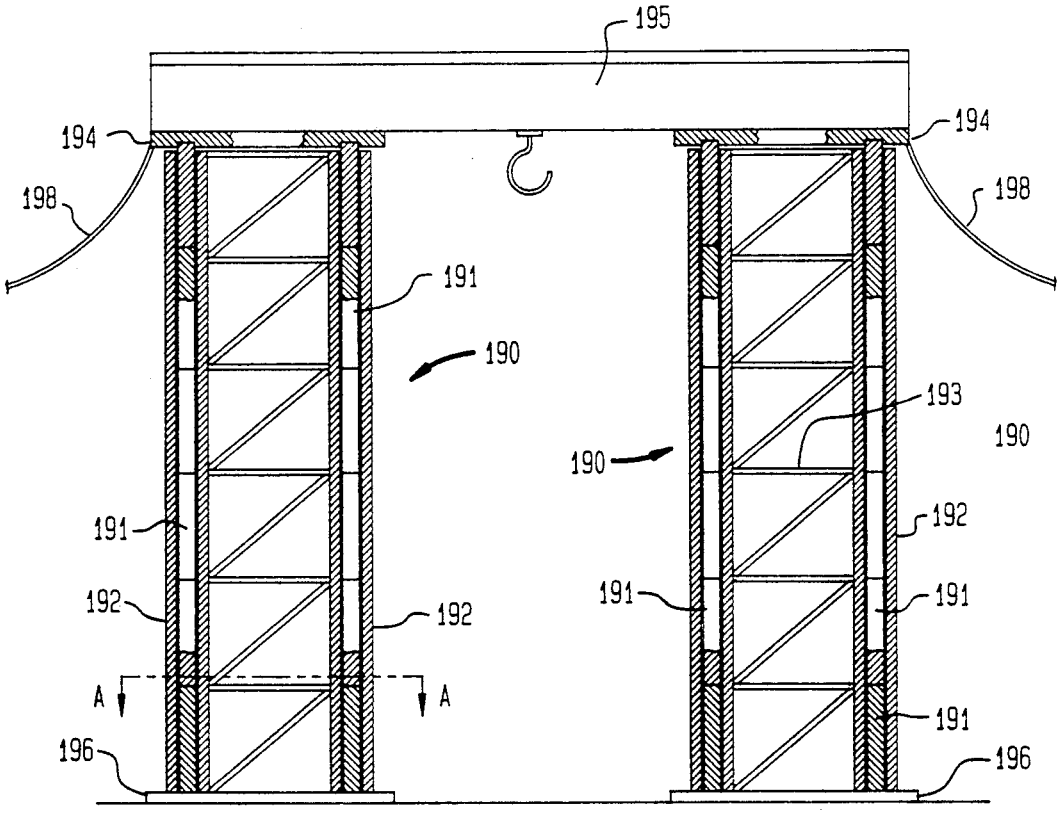
Figure 19B:
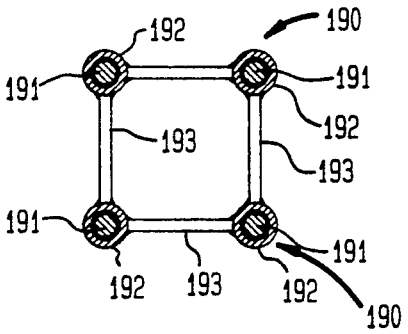
Figure 20A:
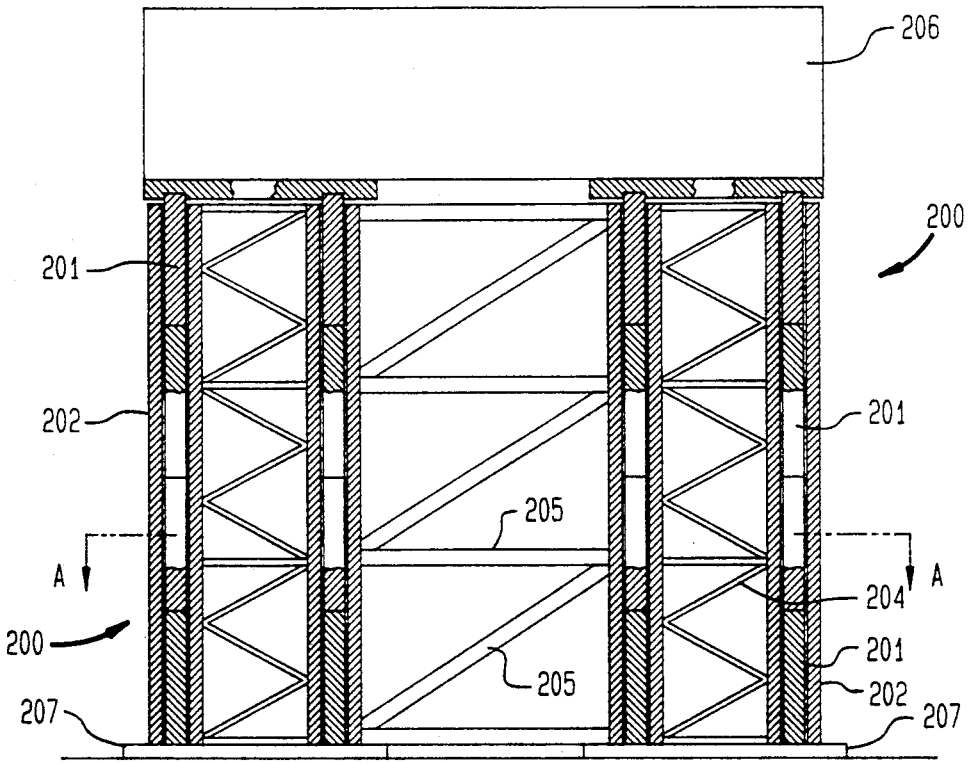
Figure 20B:
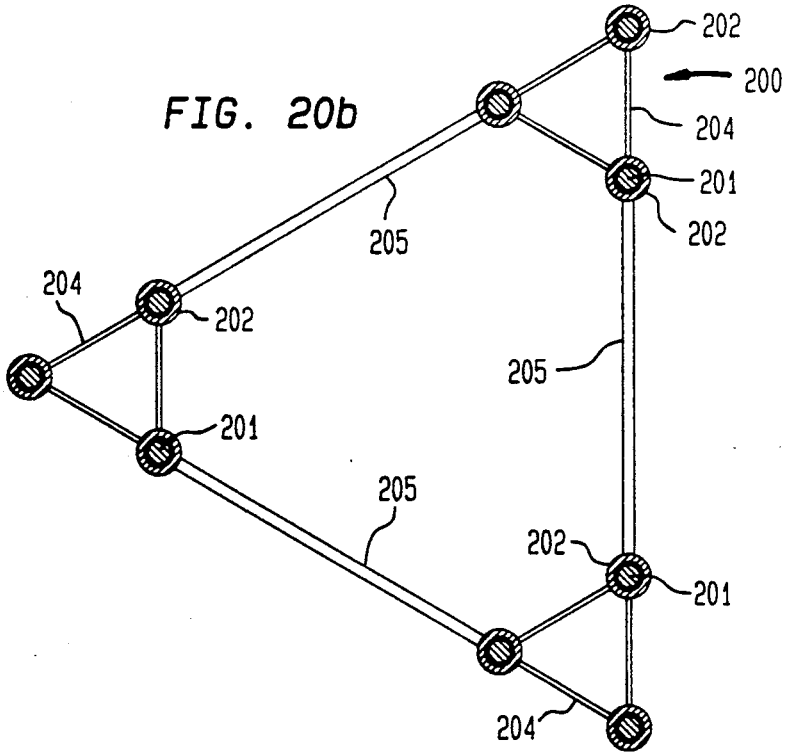

FIG. 11 is a graph comparing buckling load with numbers of core segments of a sleeved compression member;

FIG. 12*a* is a sectional view of a single sleeved adjustable prop according to the invention;

FIG. 12*b* is an enlarged cross-section of FIG. 12*a* taken along lines A—A;

FIG. 12*c* is an enlarged cross-section of a different embodiment of a single sleeved prop;

FIG. 13*a* is a schematic partial sectional view of a crane having a boom according to the invention;

FIG. 13*b* is a cross-section of FIG. 13*a* taken along lines A—A;

FIG. 13*c* is a view similar to FIG. 13*b* of a further embodiment of a boom;

FIG. 13*d* is a view similar to FIG. 13*a* of a still further embodiment of a boom;

FIG. 14*a* is a schematic side secitonal view of a latticed sleeved adjustable prop according to the invention;

FIG. 14*b* is a cross-section of FIG. 14*a* taken along lines A—A;

FIG. 14*c* is a view similar to FIG. 14*b* of a further embodiment of a latticed prop;

FIG. 15*a* is a schematic partial sectional view of a crane having a latticed boom according to the invention;

FIG. 15*b* is a cross-section of FIG. 15*a* taken along lines A—A;

FIG. 15*c* is a view similar to FIG. 15*b* of a further embodiment of a latticed boom;

FIG. 16*a* is a sectional side view of a latticed sleeved scaffolding system according to the invention;

FIG. 16*b* is a cross-section of FIG. 16*a* taken along lines A—A;

FIG. 17 is a partial sectional front view of an industrial structure having sleeved columns according to the invention;

FIG. 18*a* is a side sectional view of a sleeved extraction piling rig according to the invention;

FIG. 18*b* is a cross-section of FIG. 18*a* taken along lines A—A;

FIG. 18*c* is a view similar to FIG. 18*b* of a further embodiment of a pile extraction rig according to the invention;

FIG. 19*a* is a side sectional view of a sleeved gallow derrick according to the invention;

FIG. 19*b* is a cross-sectional view of FIG. 19*a* taken along lines A—A;

FIG. 20*a* is a side sectional view of an off-shore rig according to the invention; and, FIG. 20*b* is a cross-section of FIG. 20*a* taken along lines A—A.

DESCRIPTION OF THE PREFERRED EMBODIMENTS

Analysis of Sleeved Compression Member Having Single Core Piece

In structural engineering practice it is known that for very long columns the slenderness ratio can be effectively reduced to reduce the possibility of the column buckling on application of a compression load by providing adequate lateral restraints at calculated heights and thus permit higher permissible stresses in axial compression. The lateral restraint is generally provided by means of ties or struts.

I have found that installing a sleeve around the column can also provide the necessary lateral restraint so long as the axial load is applied to the core of the column and not to the sleeve. The result is that where very heavy axial loads are to be supported, the total structure of the core and the surrounding sleeve may be less than when only a single piece column is used leading to less column weight and expense.

This is shown by the following analysis and by reference to FIGS. 1–4 which depict a compression member made up of a single piece core surrounded by a sleeve. As shown the core has a length l and is pinned at its ends to be subject to an axial compression load P. It is assumed that the core is slender and has an initial deflection even under no load condition so that the end of the core and the center of the core are touching the sleeve as shown in FIG. 1*a*. So the initial deflection of the core at the center is equal to the difference between the inside diameter of the sleeve and the diameter of the core. This assumption is necessary in order to get a unique solution for the deflection and stresses as a function of load P. It is believed that by assuming an initial deflection for the core, one gets a conservative value for the load carrying capacity of the core.

Figure 1B:
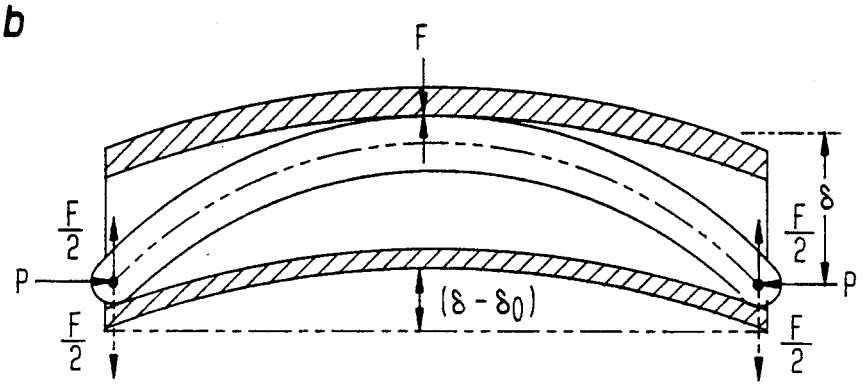
FIG. 1*b* is a sketch of the compression member of FIG. 1*a* subjected to a load.

When a load P acts the core tends to deflect laterally but its deflection would be restrained by the reacting forces introduced by the sleeve which is subjected to bending as shown in FIG. 1*b*. It is assumed that pin supports of the core are free to deflect axially (even though it may be a very small amount) and there is no friction between the core and inside surface of the sleeve. Thus the sleeve is not subjected to any axial load. In FIG. 1*b* the forces indicated by full lines are the ones acting on the core and the forces indicated by dashed lines are the ones acting on the sleeve.

If $\delta$ is the deflection of the core at the center due to load P, then it is obvious that the reacting force F acting at the center of the core due to the restraint provided by the sleeve is proportional to the deflection $(\delta-\delta_0)$ to which the sleeve is subjected. The constant naturally depends on the stiffness of the sleeve in bending.

Figure 2A:
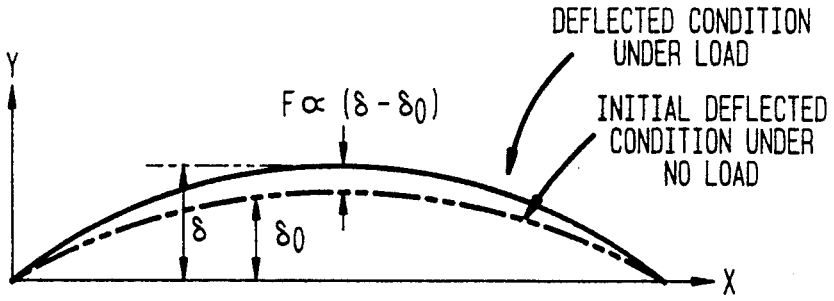
FIG. 2*a* is a schematic load diagram of the core of FIG. 1*b;*
Figure 2B:
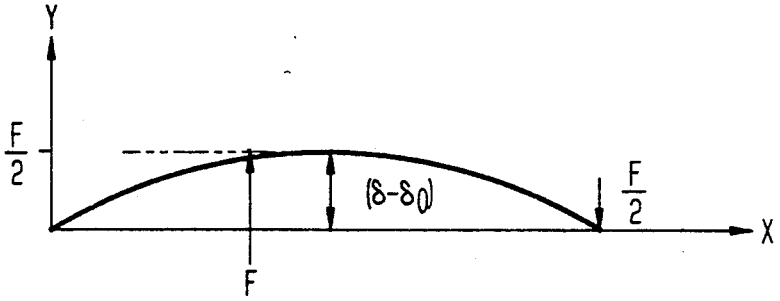
FIG. 2*b* is a schematic load diagram of the sleeve of FIG. 1*b;*

Therefore to analyze the core with a sleeve subjected to an axial load P, it is sufficient to analyze a core subjected to loads as indicated schematically in FIG. 2*a* but noting that the force F is that which is needed to deflect the sleeve by an amount $(\delta-\delta_0)$ as shown schematically in FIG. 2*b*.

It is assumed that the initial shape of the core is given by:

$$y_0 = \delta_0 - C(x - l/2)^2 \tag{1}$$

where $$C = \frac{4\delta_0}{l^2} \text{ and } \frac{d^2y_0}{dx^2} = \text{constant} = -2C$$

It is assumed that the additional deflections introduced due to P and F are small. Therefore the linear elastic theory can be used and it is assumed that the moments created due to these loads are proportional to the additional curvature (approximated by increase in $$\frac{d^2y}{dx^2}).$$

In other words if the final deflection of the column is y−f(X), then:

$$\frac{d^2y}{dx^2} - \frac{d^2y_0}{dx^2} = \frac{M}{EI} \tag{2}$$

where $$M = \frac{F}{2}x - Py \tag{3}$$

$$\text{Let } K_1^2 = \frac{P}{EI}$$

$$K_2^2 = \frac{F}{2EI}. \tag{4}$$

where E is the elastic modulus of the material of the core and I is the moment of inertia of the cross-section of the core.

Then equation (2) reduces:

$$\frac{d^2y}{dx^2} + K_1^2y = -2C + K_2^2x \tag{5}$$

The general solution to the above differential equation (5) is:

$$y = C_1\cos K_1x + C_2\sin K_1x + \left(\frac{K_2}{K_1}\right)^2 x - \frac{2C}{K_1^2} \tag{6}$$

The particular solution to this problem with the boundary conditions:

$$y = 0 \text{ at } x = 0 \tag{7}$$

$$\frac{dy}{dx} = 0 \text{ at } x = \frac{l}{2}$$

is given by:

$$y = \frac{2C}{K_1^2}\cos K_1x + \left\{\frac{2C}{K_1^2}\tan\frac{K_1l}{2} - \left(\frac{K_2}{K_1}\right)^2 \cdot \frac{1}{K_1\cos\frac{K_1l}{2}}\right\}\sin K_1x + \left(\frac{K_2}{K_1}\right)^2 x - \frac{2C}{K_1^2} \tag{8}$$

for $0 < x < \frac{l}{2}$

The solution for $$\frac{l}{2} < x < l$$

would be a mirror image about $$x = \frac{l}{2}$$

from symmetry considerations.

It may be pointed out that F, and consequently $K_2$ is not an independent parameter since F is a restraining force generated by the sleeve resisting the bending and its value is proportional to the deflection of the sleeve. If $\delta$ is the final deflection of the core at the center, then the deflection of the sleeve is $(\delta-\delta_0)$.

Considering the loads acting on the sleeve as indicated in FIG. 2*b*, it is obvious that the sleeve is acting like a beam subjected to a concentrated load F at the center. Therefore:

$$(\delta - \delta_0) = \frac{Fl^3}{48EI_s} \tag{9}$$

Where $I_s$ is the moment of inertia of the cross-section of the sleeve. Substituting for F/2EI as $K_2^2$ in (9), we get:

$$K_2^2 = \frac{24I_s}{l^3I}(\delta - \delta_0) = K(\delta - \delta_0) \tag{10}$$

where $$K = \frac{24}{l^3}\left(\frac{I_s}{I}\right) \tag{11}$$

Thus $K_2^2$ depends on the $\delta$, the value of y at $$x = \frac{l}{2}.$$

Therefore in order to find $\delta$, we substitute $$x = \frac{l}{2},$$

$y=\delta$ and $K_2^2=K(\delta-\delta_0)$ in equation (8) and simplify to get $$\delta = \frac{\frac{2C}{K_1^2} + \frac{KCl^2}{4K_1^3}\cdot\sin\frac{K_1l}{2} - \frac{KCl^3}{8K_1^2}\cdot\cos\frac{K_1l}{2} - \frac{2C}{K_1^2}\cdot\cos\frac{K_1l}{2}}{\cos\frac{K_1l}{2} + \frac{K}{K_1^3}\sin\frac{K_1l}{2} - \frac{Kl}{2K_1^2}\cdot\cos\frac{K_1l}{2}} \tag{12}$$

Note that the deflection $\delta$ at the center of the core depends upon the load P, the structural properties of the core and sleeve and the initial deflection $\delta_0$.

Substituting the expression for $\delta$ given by equation (12) in equation (10) and noting that $$\delta_o = \frac{Cl^2}{4}, \text{ one gets}$$

$$K_2^2 = K\left\{\frac{\frac{2C}{K_1^2} - \frac{2C}{K_1^2}\cdot\cos\frac{K_1l}{2} - \frac{Cl^2}{4}\cdot\cos\frac{K_1l}{2}}{\cos\frac{K_1l}{2} + \frac{K}{K_1^3}\cdot\sin\frac{K_1l}{2} - \frac{Kl}{2K_1^2}\cdot\cos\frac{K_1l}{2}}\right\} \tag{13}$$

Since all the quantities on the right-hand side of the equation (13) are known, $K_2^2$ can be found. To find y, $K_2^2$ is then substituted in equation (8). If one wishes, one can substitute the expression for $K_2^2$ from equation (13) in equation (8) to get an expression for y in terms of known quantities above, but it is not considered essential.

Once the deflection y is known, then the bending moment acting on the core can be found from equation (3). The stresses on the core due to the axial load P and due to bending moment can be then calculated. It may be noted that the bending moment on the core due to the restraining forces of the sleeve are opposite in nature to that caused by the load P and hence bending stresses in the core in the presence of the sleeve would be very much reduced.

Since the sleeve acts like a simply supported beam with a force F at the center, the bending stresses in the sleeve can be easily calculated by substituting the value of $\delta$ found from equation (12) in equation (9).

Thus the core surrounded by a sleeve subjected to a compressive load P can be fully analyzed.

Theoretical Observations for a Sleeved Compression Member Having a Single Core Piece Considering the expression for $\delta$, given by equation (12) which is repeated here for convenience.

$$\delta = \frac{\frac{2C}{K_1^2} + \frac{KCl^2}{4K_1^3} \cdot \sin\frac{K_1 l}{2} - \frac{KCl^3}{8K_1^2} \cdot \cos\frac{K_1 l}{2} - \frac{2C}{K_1^2} \cdot \cos\frac{K_1 l}{2}}{\cos\frac{K_1 l}{2} + \frac{K}{K_1^3} \cdot \sin\frac{K_1 l}{2} - \frac{Kl}{2K_1^2} \cdot \cos\frac{K_1 l}{2}} \quad (12)$$

Substituting for $C = \frac{4\delta_0}{l^2}$ and $K = \frac{24}{l^3}\left(\frac{I_s}{I}\right)$, in equation (12) and simplifying one gets:

$$\delta = \delta_o \left\{ \frac{\frac{8}{K_1^2 l^2}\left(1 - \cos\frac{K_1 l}{2}\right) + 3\left(\frac{I_s}{I}\right)\frac{\sin\frac{K_1 l}{2}}{\left(\frac{K_1 l}{2}\right)^3} - 3\left(\frac{I_s}{I}\right)\frac{\cos\frac{K_1 l}{2}}{\left(\frac{K_1 l}{2}\right)^2}}{\cos\frac{K_1 l}{2} + 3\left(\frac{I_s}{I}\right)\frac{\sin\frac{K_1 l}{2}}{\left(\frac{K_1 l}{2}\right)^3} - 3\left(\frac{I_s}{I}\right)\frac{\cos\frac{K_1 l}{2}}{\left(\frac{K_1 l}{2}\right)^2}} \right\} \quad (14)$$

Buckling of this sleeved column can be taken to occur when $\delta \rightarrow \infty$. This means $$\left\{ \cos\frac{K_1 l}{2} + 3\left(\frac{I_s}{I}\right)\frac{\sin\frac{K_1 l}{2}}{\left(\frac{K_1 l}{2}\right)^3} - 3\left(\frac{I_s}{I}\right)\frac{\cos\frac{K_1 l}{2}}{\left(\frac{K_1 l}{2}\right)^2} \right\} = 0 \quad (15)$$

Figure 3:
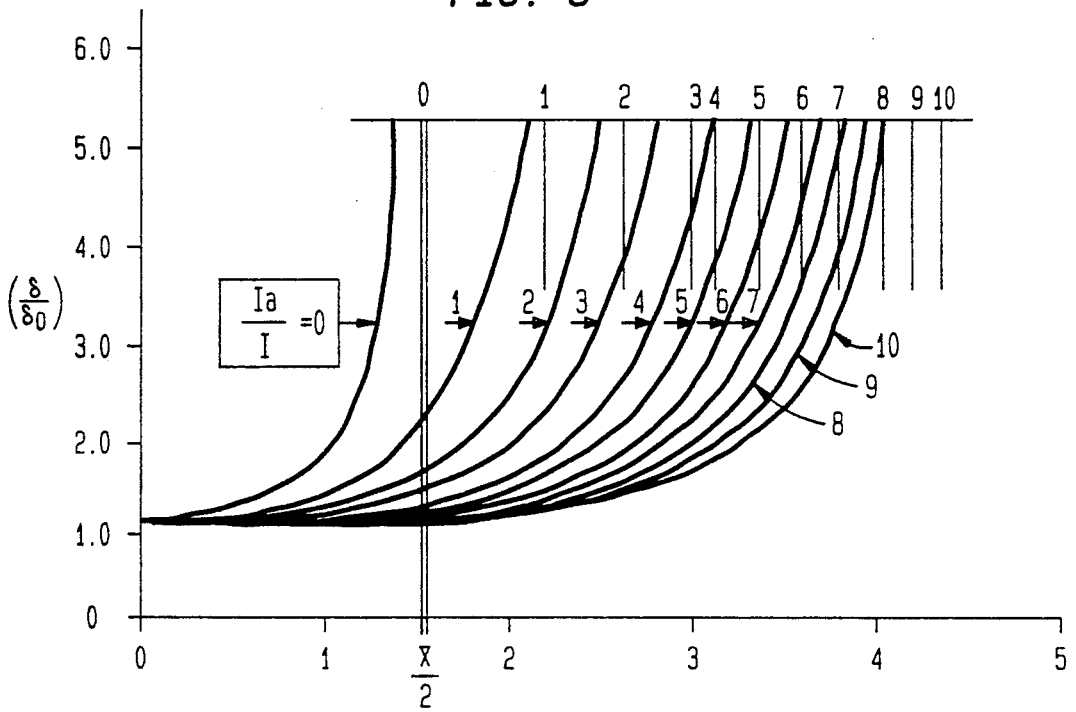
FIG. 3 is a graph illustrating the ratio of $$\frac{\delta}{\delta_0} \text{ vs. } \frac{k_1 l}{2}$$

For a given value of $I_s/I$, the value of $K_1$ which satisfies the equation (15) gives the buckling load P through the relation $P = K_1^2 EI$. It may be noted that the buckling load is independent of $\delta_0$. FIG. 3 shows the ratio of $$\frac{\delta}{\delta_0} \text{ vs. } \frac{K_1 l}{2}$$

for various values of $I_s/I$.

For the extreme case if $$\frac{I_s}{I} = 0,$$

corresponding to the case of no sleeve, the buckling load is given by:

$$\cos\frac{K_1 l}{2} = 0$$

$$\text{i.e. } \frac{K_1 l}{2} = \frac{\lambda}{2}, \; P = \left[\frac{\lambda^2 EI}{l^2}\right]$$

which corresponds to Euler's equation for the buckling of pin jointed columns.

For the other extreme case of $$\frac{I_s}{I} \rightarrow \infty$$

corresponding to the case where the sleeve is extremely rigid as compared to core, it is obvious from equation (14) that $\delta \rightarrow \delta_0$ as $$\frac{I_s}{I} \rightarrow \infty.$$

This would imply that $$\frac{K_1 l}{2} \rightarrow \infty.$$

However this does not necessarily imply that the buckling load goes to $\infty$ since $P = K_1^2 EI$ and $I \rightarrow 0$ as $$\frac{I_s}{I} \rightarrow \infty$$

for a given $I_s$. Therefore in order to know the effect of $I_s/I$ on the buckling load, the following procedure is adopted. The variation $K_1 l/2$ with $I/I_s$ is obtained and the result is shown in FIG. 4.

The expression $P = K_1^2 EI$ can be expressed in the form:

$$\frac{P\left(\frac{l}{2}\right)^2}{EI_s} = \left(\frac{K_1 l}{2}\right)^2 \cdot \frac{I}{I_s}.$$

Note that $$\frac{K^1 l}{2} \rightarrow \infty \text{ as } \frac{I}{I_s} \rightarrow 0$$

and the product $$\left(\frac{K_1 l}{2}\right)^2 \frac{I}{I_s}$$

gives an indication of the buckling load for a given l and $I_s$. On the same figure $$\frac{P}{EI_s}\left(\frac{l}{2}\right)^2$$

is plotted against $I/I_s$. It is seen that for a given $I_s$ the buckling load increases as $I/I_s$ increases.

It may be noted that the ratio of $P_{sc}$, the buckling load of the sleeve column to the buckling load $P_c$ of the simple column is given by:

$$\frac{P_{sc}}{P_c} = \frac{K_1^2 EI}{\frac{\lambda^2}{l} EI} = \frac{4}{\lambda^2}\left(\frac{K_1 l}{2}\right)^2$$

and its variation with $I/I_s$ is also indicated in the same figure.

It should be pointed out that in the above analysis the buckling load was considered where the deflection tends to infinity. No account of the stresses induced in the core or sleeve was taken into consideration in arriving at the buckling load. However for a given configuration and a given applied load, it is possible to calculate the stresses in the core and sleeve. For long sleeved cores the stresses in the core and sleeve will be within the yield value as long as the deflection does not go to infinity and at buckling load, both deflections and stresses suddenly go to infinity. On the other hand for short cores as the load is increased, the core can reach the yield stress (if the sleeve is stiff enough) with the stresses in the sleeve still being well within elastic limit. Once yield stress is reached in the core, the present analysis is, strictly speaking, not fully valid since it is based on elastic theory. However on the assumption that this theory can be extended beyond this limit, since the system is not expected to fail when the core reaches the yield stress, the increased load can be calculated at which the sleeve reaches the yield stress. It is the hypothesis that the system will fail when the sleeve reaches the yield stress even though at this load the stress in the core might have far exceeded the yield stress. This load would be less than the buckling load based on the criteria of deflection going to $\infty$.

Experiments were carried out to confirm this hypothesis on a compression member of the configuration shown in FIG. 1*a*. The O.D. of the sleeve was 2.17 cm I.D. 1.73 cm and the material steel to specification I.S. 226 having a minimum yield strength of 2.52/cm$^2$. The core was of the same material as the sleeve, was solid and had a diameter of 1.5 cm.

Table 1 below gives the theoretical analysis for the above configuration for increasing loads:

| Load in tons (tons) | Bending stress in sleeve (tons/sq. cm.) | Combined bending and axial stress in core. (ton/sq. mm.) |
|---|---|---|
| 3.75 | 1.68 | 2.52 |
| 5.0 | 2.34 | 3.24 |
| 5.30 | 2.52 | 3.44 |
| 6.1 | 3.10 | 4.02 |
| >19.1 Theoritical buckling load considering deflection going to $\infty$ | | |

It can be seen from the above table if P=3.75 tons, the core reaches the yield stress. In the experiment the configuration did not fail at this load. Theoretically when P=5.30 tons, the sleeve also reaches the yield stress. In the experiment the configuration failed at P=5.0 tons which is approximately close to the theoretical value at which the sleeve reached the yield stress. It may be noted with interest that at this load, the theoretical stress in the core was 3.24 tons/sq.cm. which was much beyond the yield stress of 2.52 tons/sq.mm. of the core material. The load at which the theoretical buckling takes place on the criteria of deflection going to $\infty$ is also shown in the above table but is of no practical consideration for the short core considered.

In the above experiment, after the stress in the core reached the yield stress, future loading was not stopped but continued at a steady rate. The creep phenomenon was not considered. In the above table it can be seen that at a load of more than 3.75t/cm$^2$ the stress in the core is higher than the yield stress and therefore the elastic theory is no longer applicable. However in many tests it was found that the core went into a crushing stage with extremely high stresses In some tests the stress in the core was in the order of 8 ton/cm$^2$ at failure. The experimental results obtained are plotted on the theoretical results of variations of $$\frac{P\left(\frac{l}{2}\right)^2}{EI_s} \text{ vs. } \frac{I}{I_s}$$

as shown in FIG. 5.

Analysis of Sleeved Compression Member Having A Core Comprising a Plurality of Equal Pieces Reference is made to the sleeved compression member illustrated in FIG. 6*a* having two equal discontinuous core pieces inside a sleeve Unlike the case of the configuration in FIG. 1 where the single core initially was assumed to be bent to take up the eccentricity $\delta_0$ between the core and the sleeve, here the core pieces are assumed to be straight but inclined so that the eccentric gap is taken up. It is further assumed that the interfaces between the discontinuous core pieces act as pinned joints and the core pieces do not take any moments. This means that even after the application of the axial load P, the core pieces remain straight individually but the inclination will change. The final inclinations attained by the pieces are such that the lateral forces generated at the discontinuous core ends is just balanced by the lateral restraint or resisting force offered by the sleeve due to resistance to bending. It may be mentioned here, that in a strict sense, the resisting force or reaction offered by the sleeve has to be normal to the inner surface of the sleeve and therefore would not be normal to the axis of loading and thus strictly not lateral It is assumed that the inclinations involved are small and therefore the reaction forces can be assumed to be lateral i.e., normal to the axis of loading and therefore simple bending theory can be applied to the analysis of the sleeve in arriving at the equilibrium condition of the sleeved column. The forces acting on the core pieces and sleeve for the case of two discontinuous cores are shown in FIGS. 6*b* and 6*c*. The deflection $\delta$ under the equilibrium has to be such that the force F needed for the sleeve to deflect by $\delta$ should be equal to the force needed by the discontinuous pieces to be in equilibrium at the inclination $\theta$ which is governed by $\delta$. As in the case of the configuration of FIG. 1*a* the buckling load is assumed to be that at which $\delta \rightarrow \infty$. These ideas become clear when the analysis of the individual cases which follow are considered.

The general formulation and basis for analyzing multi-discontinuous core pieces inside a sleeve is the same. However unlike the two discontinuous core pieces, the number of initial positions that discontinuous core pieces can take is (n−1) and the buckling load for each of these positions would be different.

An analysis of a few typical cases of discontinuous core pieces in a sleeve would follow:

Case 1: Two Equal Discontinuous Core Pieces

From FIG. 6c by resolution of forces one gets:

$$F = 2P\tan\theta = \frac{4P}{L}(\delta_1 + \delta_0) \tag{16}$$

but from FIG. 4d, $$\delta_1 = \frac{FL^3}{48EI_s}$$

where $I_s$ is the moment of inertia of the sleeve, therefore:

$$F = \frac{48EI_s}{L^3} \times \delta_1 \tag{17}$$

By solving equations (16) and (17) one gets:

$$\delta_1 = \left[\frac{P\delta_o}{\frac{12EI_s}{L^2} - P}\right] \tag{18}$$

From equation (18) it can be seen that $\delta \rightarrow \infty$ if $$P \rightarrow \frac{12EI_s}{L^2}$$

therefore the buckling load $$P_{sc} = \frac{12EI_s}{L^2} \tag{19}$$

For any particular value of P and $\delta_0$, the maximum bending moment in the sleeve an be shown to be:

$$M_{max} = \frac{12EI_s}{L^2}\left[\frac{P\delta_o}{\frac{12EI_s}{L^2} - P}\right] \tag{20}$$

Case 2: Three Equal Discontinuous Core Pieces

From FIG 7c, by resolving forces, one gets:

$$F = \frac{3P}{L}(\delta_1 + \delta_0) \tag{21}$$

From FIG. 7d, the deflection $\delta_1$ under load $$\delta_1 = \frac{5FL^3}{162EI_s}$$

Where $I_s$ is the moment of inertia of sleeve from equations (21) and (22) one gets:

$$\delta_1 = \left[\frac{P\delta_o}{\frac{54EI_s}{5L^2} - P}\right] \tag{22}$$

It can be seen that $\delta \rightarrow \infty$ if $$P \rightarrow \frac{54EI_s}{5L^2}$$

Therefore the buckling load $$P_{sc} = \frac{54}{5} \cdot \frac{EI_s}{L^2}$$

Case 3: Four Equal Discontinuous Core Pieces

From FIG. 8c, by resolution of forces and solving for $F_1$ and $F_2$ one gets:

$$F_1 = \frac{4P}{L}(\delta_0 + 2\delta_1 - \delta_2) \tag{23}$$

$$F_2 = \frac{8P}{L}(\delta_2 - \delta_1) \tag{24}$$

From FIG. 8d, the sleeve deflections are as follows:

$$\delta_1 = \frac{(16F_1 + 11F_2)}{768EI_s} \cdot L^3$$

$$\delta_2 = \frac{(22F_1 + 16F_2)}{768EI_s}.$$

From equations (23) and (24) one gets:

$$\left.\begin{aligned} \delta_1 &= \frac{K_4\delta_o(8 - 7K_4)}{(7K_4^2 - 10K_4 + 1)} \\ \delta_2 &= \frac{K_4\delta_o(7K_4 - 11)}{(7K_4^2 - 10K_4 + 1)} \end{aligned}\right\} \tag{25}$$

where $$K_4 = \frac{PL^2}{96EI_s} \tag{26}$$

The deflections $\delta_1\ \delta_2 \rightarrow \infty$ if $(7K_4^2 - 10K_4 + 1) \rightarrow 0$ Therefore, at buckling condition $(7K_4^2 - 10K_4 + 1) = 0$ Therefore $K_4 = +0.10819$ and $+1.32038$ Since both the values of $K_4$ are positive, one gets two values for buckling load viz.:

$$P_{sc} = \frac{10 \cdot 38624EI_s}{L^2} \text{ and } \frac{126 \cdot 75EI_s}{L^2}$$

In view of the above, the question arises as to which value of buckling load to choose. It is assumed that the above two values correspond to the two possible symmetrical modes of deflection, the first mode being the one shown in FIG. 8*a* corresponding to the lower buckling load and the other mode the one shown in FIGS. 8*e* to 8*h* corresponding to the higher buckling load.

This assumption can be confirmed by analyzing the mode of FIGS. 8*e*–8*h* where the critical load turns out to be the same as with the modes of FIGS. 8*a*–8*d* namely $$(7K_4^2-10K_4+1)=0$$

It is obvious that the mode of FIGS. 8*e*–8*h* will be able to take much more load than that of FIGS. 8*a*–8*d* and the higher value of $K_4$ should apply to the former mode. Therefore by properly positioning the core pieces inside the sleeve, the critical load can be increased by nearly thirteen times. The mode of FIGS. 8*e*–8*h* is a stable one and is a likely mode. Therefore it may be possible to make use of it in practice.

Case 4: Five Discontinuous Core Pieces

Referring to FIGS. 9*a*–9*d* and by carrying out analysis similar to Case 3, the governing equation for the critical case turns out to be the quadratic equation:

$$(19K_5^2-16K_5+1)=0$$

$$(19K_5^2 - 16K_5 + 1) = 0$$

where $$K_5 = \frac{PL^2}{150EI_s}$$

from which the buckling loads are:

$$P_{sc} = \frac{10 \cdot 19839EI_s}{L^2} \text{ and } \frac{130EI_s}{L^2}.$$

The lower critical load corresponds to the configuration of core pieces as in FIG. 9*a* and the higher critical load corresponds to the other possible symmetrical configuration shown in FIGS. 9*e* and 9*f*.

Case 5: Six Discontinuous Core Pieces

Referring to FIGS. 10*a*–10*b* and by carrying out analysis as before, the governing equation for critical case works out to be a cubic equation:

$$(26K_6^3-57K_6^2+24K_6-i)=0$$

$$\text{where } K_6 = \frac{PL^2}{208EI_s}$$

The buckling loads corresponding to the three rooots of the above equation are:

$$P_{sc} = \left[\frac{9 \cdot 72EI_s}{L^2}\right], \left[\frac{104EI_s}{L^2}\right] \text{and} \left[\frac{341EI_s}{L^2}\right].$$

The lower critical load corresponds to the configuration shown in FIG. 10*a* and one of the other two possible symmetrical configurations shown in FIG. 10*e*.

For the case of six core pieces, the forces, deflections and moments can be shown as follows:

$$\delta_1 = \frac{-K_6\delta_o(26K_6^2 - 60K_6 + 14)}{(26K_6^3 - 57K_6^2 + 24K_6 - 1)} \quad (27)$$

$$\delta_2 = \frac{-K_6\delta_o(26K_6^2 - 59K_6 + 23)}{(26K_6^3 - 57K_6^2 + 24K_6 - 1)} \quad (28)$$

$$\delta_3 = \frac{-K_6\delta_o(26K_6^2 - 56K_6 + 26)}{(26K_6^3 - 57K^2 + 24K - 1)} \quad (29)$$

$$\text{where } K_6 = \frac{PL^2}{216EI_s}$$

$$F_1 = \frac{6P}{L}(\delta_o + 2\delta_1 - \delta_2) \quad (30)$$

$$F_2 = \frac{6P}{L}(-\delta_1 + 2\delta_2 - \delta_3) \quad (31)$$

$$F_3 = \frac{12P}{L}(\delta_3 - \delta_2) \quad (32)$$

Maximum bending moment in the sleeve:

$$M_{max} = \frac{L}{6}\left(F_1 + 2F_2 + \frac{3}{2}F_3\right) \quad (33)$$

Maximum shear force in the sleeve:

$$SF = \left(F_1 + F_2 + \frac{1}{2}F_3\right) \quad (34)$$

Maximum axial load on the core (in topmost segment)

$$P_{\lambda c} = \frac{P}{\cos\theta} \text{ where } \theta = \tan^{-1}\frac{L(\delta_1 + \delta_0)}{6} \quad (35)$$

With the help of the above equations, it is possible to find stresses in various members.

It is to be noted that the least buckling load keeps on decreasing from Case 1 to Case 5 and the results are plotted in FIG. 11.

Thus as the number of pieces increases, the critical load tends towards the Euler's buckling load for the sleeve i.e.:

$$P_{sc} = \frac{\lambda^2 EI_s}{L^2}$$

This tendency of the critical load to approach Euler's buckling load as the number of core pieces increases can be confirmed mathematically.

Referring to FIGS. 12*a*–12*c* there is illustrated an application of my improved sleeved compression member in the form of an adjustable prop. As shown the prop comprises a sleeved compression member 10 having a plurality of core pieces 11 placed end-to-end and contacting each other. The core pieces are surrounded by a sleeve 12 having a greater inside diameter than the outside diameter of the core pieces such that the sleeve is spaced from the sides of the core pieces. The sleeve preferably has a shorter axial length than the total length of the cores to insure that no axial load will be imparted to the sleeve by slab 13 of a building to be propped. The top core has a threaded portion 14 which threadingly engages an adjustment head 15. Sleeve 12 and the bottom core rest on a base plate 16.

The height or length of the prop 10 is adjusted by rotating the head 15.

While five core pieces are shown it is to be understood that the core could comprise one piece or any multiple of pieces. The important consideration is that the sleeve not be subjected to any axial load from the slab 13.

As shown in FIGS. 12*b* and 12*c* the sleeve and core may have several different forms such as a circular core-sleeve arrangement as shown in FIG. 12*a* or a circular core-square sleeve arrangement as shown in FIG. 12*c*. In both arrangements a space exists between the side of the core pieces and the inner wall of the sleeve.

On application of a compression load the core pieces may deflect as shown in FIGS. 9*a* or 9*e* where they are restrained by the sleeve.

A prop constructed as shown has less total weight than a conventional prop for supporting an equal load. Any temporary overloading of the core for a short duration will not necessarily result in failure provided that the maximum allowable stress in the sleeve is not exceeded.

The sleeve itself may have single joints designed only to accommodate sleeve stresses and since core pieces are not joined together, field assembly of the prop is easy.

Further load carrying capacity of the prop is not diminished due to inaccurate fabrication whereas in conventional props, accurate fabrication is necessary. The core pieces themselves can be made of a comparatively inexpensive material since they do not have to overcome bending stresses but only compression stresses.

A compression member according to the invention is also applicable for use as a boom in a crane as shown in FIGS. 13*a*–13*d*. There a crane is depicted having a boom 20 made up of four core pieces 21 surrounded by a sleeve 22. A lower end of the sleeve is pivotally connected by pin 23 to the crane platform 24. The upper core piece has a pulley mount 25 thereon to which a back stay 26 is connected for raising and lowering the boom. A lift line 27 rides over a pulley 28 carried by the pulley mount 25 and serves to lift a load. The sleeve is shorter than the total length of the cores to insure no axial load will be imparted on the sleeve form the pulley mount.

The core pieces as shown in FIGS. 13*b*–13*d* have a smaller diameter than the diameter of the tubular sleeve shown in FIGS. 13*b* and 13*d* and less than the distance between opposite sides of the square-shaped sleeve 22' shown in FIG. 13*c*.

The stiffness of the sleeve 22 may be increased by surrounding the sleeve with a box-like structure 29 and connecting the sleeve by bracing 30 to the box-like structure. Increasing the stiffness of the sleeve in turn increases the resistance of the compression member to buckling.

A boom constructed with the sleeved compression member will result in the weight of the boom being less as compared to a conventional boom of equal load capacity. The core may be made of inexpensive material needing a minimum of fabrication and the boom may be subjected to core loading resulting in over stressing of the core for short durations without boom failure provided the stress limit of the surrounding sleeve is not exceeded.

The ability to withstand buckling loads of the compression member may be further increased by providing a latticework of interconnected sleeves surrounding the core. Thus FIGS. 14*a*–14*b* show a latticed sleeve prop while FIGS. 15*a*–15*b* shows a crane having a latticed sleeved boom.

In the adjustable prop of FIG. 14*a* in which parts similar to parts in FIG. 12*a* have the same identifying numerals, the prop shown has a plurality of compression members each having a plurality of core pieces 10 surrounded by a sleeve 12. The sleeves 12 are interconnected by frame members 140 and 141 to form a latticework. The latticework itself adds stiffness to the sleeves resulting in the compression member being able to take heavier compression loads before buckling than if the individual sleeves were not connected by the frame member. The individual sleeves may be circular-shaped as in FIG. 14*b* or square-shaped as in FIG. 14*c*. Further the individual compression members may be joined by bracing to form latticework of a variety of shapes. Thus triangular latticework as in FIG. 14*b* may be used or square latticework as in FIG. 14*c* may be used.

Booms of cranes may likewise be made of latticed sleeved members. Referring to FIGS. 15*a*–15*c*, in which parts identical to parts in FIG. 13 have like identifying numerals, the boom 150 comprises four compression members 151. Each compression member has five equal core pieces 152 surrounded by a sleeve 153. The bottom core piece of each compression member rests on a pivotal support 154 to which each sleeve is joined.

Each top core piece has a bearing extension 155 thereon which is connected to a pulley mount 156.

The four sleeves 153 are joined by bracing 158 to form a rigid latticework which provides increased stiffness to the individual sleeves thus increasing the ability of individual compression members to resist buckling.

As shown in FIG. 15*b*, the core pieces may be cylindrical surrounded by cylindrical sleeves or, as shown in FIG. 15*c*, the core pieces 152' may be square-shaped in cross-section surrounded by square-shaped sleeves 153'.

As with the boom of the crane of FIG. 13*a*, the sleeve of each compression member has an axial length less than the total length of the core pieces resulting in a space between the upper end of the sleeve and the bearing extension thus preventing any transmission of axial loads from the bearing extensions to the sleeve.

The sleeved compression members of the invention are useful as structural members in a sleeved scaffolding system an example of which is shown in FIGS. 16*a* and 16*b*. There the system comprises a plurality of compression members 160 each formed of a plurality of equal core pieces 161 surrounded by a sleeve 162. The sleeve and bottom core pieces of each compression member rests on a base 30 plate 163. A loading plate 164 rests on the top core piece and in turn supports a beam 165 of the scaffold.

As in the prior construction involving a sleeved compression member according to the invention, the axial length of the sleeve is less than that of all the core pieces to provide a space between the loading plate and axial ends of the sleeve to insure no axial loads will be applied to the sleeve by the loading plate.

The sleeves are connected by cross bracings 166 as well as by diagonal bracings 167 to provide for a rigid structure and to further increase rigidity of the sleeves to increase resistance of the compression members against buckling.

The use of the sleeved compression members results in total weight of the scaffolding being less than that of conventional scaffolding for supporting a given load, results in a structure which may be broken down into convenient lengths for ease of transport and field assembly, allows use of inexpensive material for the core pieces, allows use of parts which do not have to be fabricated to close degrees of tolerance and allows temporary overloading of the core pieces for a short duration providing that the permissible stresses in the sleeves are not exceeded.

Referring to FIG. 17 there is disclosed an industrial structure having sleeved columns supporting a roof of the structure and separate sleeved columns supporting a crane. As shown sleeved compression members 170 form supporting columns for a roof truss 171. Each supporting column comprises a core 172 surrounded by a sleeve 173 which is of less axial length than the core 172 to provide a space between the top of the sleeve and the roof truss. The core may as shown comprise a single piece or a multiplicity of equal pieces.

The supporting members 175 comprise supporting columns for a crane 176 where each supporting column comprises a plurality of core pieces 177 surrounded by a sleeve 178. As with the supporting columns for the roof truss, the sleeve 178 of each column 175 is shorter than the total length of the core pieces 177 to insure a space between the crane and top of the sleeve to prevent axial loads from the crane being imparted onto the sleeve.

Lateral braces 179 are provided to resist wind and earthquake loads while cross braces 179' extending between sleeves 173 and 178 provide a latticework to increase the rigidity or stiffness of the sleeves and thus increase the strength of the columns to withstand buckling forces.

A sleeved extraction piling apparatus is disclosed in FIGS. 18*a*–18*c* incorporating sleeved compression members according to the invention. The apparatus includes two sleeved compression members each of which has a plurality of equal core pieces 181 surrounded by a sleeve 182. A loading plate 183 extends across the top core pieces of each of the sleeved compression members.

Two tubular columns 184 are connected by cross bracing 185 to the sleeves 182 to form a vertical latticed tower.

Pulleys 186 are mounted on top of the tower over which a pile extraction rope 186' extends and by which a pile casing 187 may be extracted. Pulleys 188 are also mounted on the top of the latticed tower over which a pile handling rope 188' extends by which piling may be handled.

The compression members 180 may, as shown in FIG. 18*b*, comprise circular core pieces and the sleeves circular tubes with columns 184 comprising similar circular tubes. In the alternative, the core pieces 181' may be square in cross-section while sleeves 182' and columns 184' may also be square-shaped.

Gallow derricks of the general type as illustrated in FIGS. 19*a* and 19*b* provide a further example of use of sleeved compression members according to the invention. As shown such a derrick comprises a plurality of sleeved compression members 190 each comprising a plurality of core pieces 191 surrounded by a sleeve 192. In the particular derrick shown four sleeves are connected by cross bracing 193 to form a latticed tower. A loading plate 194 extends across the top core pieces of each tower to support a lifting beam 195 of the derrick. The sleeves and bottom core pieces of each of the latticed towers are supported by a base plate 196. Guys 198 provide stability to the derrick structure.

The sleeves 192 are of shorter length than the total length of the cores of each of the compression members to provide a space between the end of the sleeve and the loading plate and to insure that no axial loads are imparted to the sleeve by the loading plate.

A still further application of sleeve compression members according to the invention is to form supporting legs of an off-shore platform. Referring to FIGS. 20*a* and 20*b*, there is illustrated an off-shore platform having a plurality of compression members 200 forming supporting legs for the platform. Each leg comprises a plurality of equal core pieces 201 surrounded by a sleeve 202. Three sleeves are joined by bracing 204 to form a latticed leg and the latticed legs, of which there are three, are joined by main braces 205 such that the latticed legs may resist wind and wave action.

The top of the top core pieces in each leg 200 support the loading platform 206 while the bottom ends of the sleeves and bottom core pieces are supported by base plates 207.

As seen by reference to the drawings the sleeved compression members according to the invention may be used in a number of structures where compression loads are imparted and where the member must withstand buckling loads.

In all structures where the sleeved compression member is used, the resultant structure may weigh less than conventional structures needed to support or withstand a given load, may be made of parts which do not require close manufacturing tolerances, the core pieces may be made of inexpensive material, the members may be broken down into convenient lengths for shipment and assembly and the core pieces may be subjected for a short time to stresses beyond their yield points provided that the stresses in the sleeve are maintained within their permissible limits.

I claim:

1. A sleeved compression member having improved resistance to buckling when subjected to a compression load applied to axial ends of the compression member, characterized in that said compression member comprises a core adapted to be subjected to said compression load imparted onto axial ends of the core and includes a plurality of discrete parts placed end-to-end in a zigzag manner so as to contact one another, and a hollow sleeve surrounding said core with the inner sides of said sleeve engaging only the ends of said discrete parts of said core, said sleeve adapted to be subjected to only bending forces when said core bends under the force of said compression load.

2. A sleeved compression member according to claim 1 further characterized in that the axial length of said sleeve is less than the axial length of said core to assure that none of the compression load imparted onto the axial ends of said member will be imparted to said sleeve.

3. A crane having a boom and wherein said boom comprises a sleeved compression member according to claim 1.

4. A building column for an industrial structure wherein said column comprises a sleeved compression member according to claim 1.

5. A pile extraction device including a compression column wherein said column comprises a sleeved compression member according to claim 1.

6. A off-shore drilling platform supported by a plurality of legs wherein at least one said leg comprises a compression member according to claim 1.

7. An adjustable prop comprising a sleeved compression member according to claim 1.

8. A gallow derrick including supporting columns and wherein each said supporting column comprises a sleeved compression member according to claim 1.

9. A latticework comprising a plurality of parallel extending compression members each constructed according to claim 1 and joined by frame pieces.

10. A latticework according to claim 9 further characterized in that the axial length of each said sleeve is less than the axial length of the core which it surrounds to assure than none of the compression load imparted onto the axial ends of the core will be imparted to the surrounding sleeve.

11. A crane having a boom and wherein said boom comprises a latticework according to claim 10 or 10.

12. A building support for an industrial structure wherein said support comprises a latticework according to claim 9 or 10.

13. A pile extraction device including a latticework according to claim 9 or 10.

14. An off-shore drilling platform supported by a plurality of legs wherein at lest one said leg comprises a latticework according to claim 9 or 10.

15. An adjustable prop comprising a latticework according to claim 9 or 10.

16. A gallow derrick including supporting columns and wherein each supporting column comprises a latticework according to claim 9 or 10.

17. A scaffolding structure having supporting structure in the form of latticework according to claim 9 or 10.

* * * * *

UNITED STATES PATENT AND TRADEMARK OFFICE

CERTIFICATE OF CORRECTION

PATENT NO. : 5,175,972

DATED : January 5, 1993

INVENTOR(S) : Benne N. Sridhara

It is certified that error appears in the above-indentified patent and that said Letters Patent is hereby corrected as shown below:

Column 1, line 23, change "(" to --I is--;

Column 22, claim 11, change the first "10" to --9--.

Signed and Sealed this

Twenty-eighth Day of December, 1993

*Attest:*

Bruce Lehman

BRUCE LEHMAN

*Attesting Officer*

*Commissioner of Patents and Trademarks*